US010188153B1

(12) United States Patent
Proctor et al.

(10) Patent No.: US 10,188,153 B1
(45) **Date of Patent: *Jan. 29, 2019**

(54) GARMENT SYSTEM FOR INTERCHANGEABLE COVERS FOR GARMENT STRAPS

(71) Applicant: Strap Appeal, Virginia Beach, VA (US)

(72) Inventors: Ashley Proctor, Virginia Beach, VA (US); Myra J. Crouch, Virginia Beach, VA (US)

(73) Assignee: STRAP APPEAL, Virginia Beach, VA (US)

( * ) Notice: Subject to any disclaimer, the term of this patent is extended or adjusted under 35 U.S.C. 154(b) by 314 days.

This patent is subject to a terminal disclaimer.

(21) Appl. No.: 14/807,325

(22) Filed: Jul. 23, 2015

Related U.S. Application Data

(63) Continuation-in-part of application No. 14/479,505, filed on Sep. 8, 2014, now abandoned, which is a continuation-in-part of application No. 13/728,690, filed on Dec. 27, 2012.

(60) Provisional application No. 61/580,694, filed on Dec. 28, 2011.

(51) Int. Cl.
*A41C 3/12* (2006.01)
*A41C 3/00* (2006.01)

(52) U.S. Cl.
CPC ..... *A41C 3/12* (2013.01)

(58) Field of Classification Search
CPC ..... A41C 3/12; A41C 3/00
USPC ..... 450/86; 2/310–312, 336, 338
See application file for complete search history.

(56) References Cited

U.S. PATENT DOCUMENTS

| | | | | |
|---|---|---|---|---|
| 1,717,933 | A | 6/1929 | Phyrne Morin et al. | |
| 3,046,991 | A | 7/1962 | Heberling | |
| 3,311,112 | A | 3/1967 | Murray | |
| 3,848,270 | A | 11/1974 | Rand | |
| 4,941,237 | A | 7/1990 | Hovis | |
| 5,172,428 | A | 12/1992 | Leinoff | |
| 5,309,608 | A | 5/1994 | Lucas | |
| 5,478,278 | A | 12/1995 | Greenblatt | |
| 5,555,561 | A * | 9/1996 | Plachta | A41D 13/0005 2/270 |
| 5,656,507 | A | 8/1997 | Welbourn et al. | |
| 5,852,829 | A * | 12/1998 | Relaford | A41F 9/002 2/311 |
| 5,914,166 | A * | 6/1999 | Le | A41F 15/02 2/268 |

(Continued)

OTHER PUBLICATIONS

Ashley Proctor, U.S. Appl. No. 14/807,819, filed Jul. 23, 2016.
Myra J. Crouch, U.S. Appl. No. 14/922,302, filed Oct. 26, 2015.

*Primary Examiner* — Gloria Hale
(74) *Attorney, Agent, or Firm* — Williams Mullen, PC; M. Bruce Harper

(57) ABSTRACT

A bra strap cover system is disclosed. The system includes a bra including at least one shoulder strap and a decorative bra strap cover. The shoulder strap of the bra includes a plurality of fasteners attached to its upper surface. The underside of the bra strap cover includes a plurality fasteners attached thereto. The bra strap cover is configured to be removably attached to the bra strap such that the bra strap cover substantially covers and overlies the upper surface of the shoulder strap.

13 Claims, 28 Drawing Sheets

(56) References Cited

U.S. PATENT DOCUMENTS

| | | | | |
|---|---|---|---|---|
| 5,951,364 | A * | 9/1999 | Brown | A41C 3/02 2/109 |
| 6,186,861 | B1 | 2/2001 | Flaherty | |
| 7,833,085 | B2 * | 11/2010 | Crouch | A41F 15/02 2/338 |
| 7,931,521 | B1 | 4/2011 | Griffin | |
| 8,469,772 | B2 * | 6/2013 | Crouch | A41F 15/00 2/338 |
| 8,808,058 | B2 * | 8/2014 | Crouch | A41F 15/002 2/336 |
| 2003/0003844 | A1 | 1/2003 | Jones et al. | |
| 2006/0000068 | A1 | 1/2006 | Fraser | |
| 2009/0117826 | A1 * | 5/2009 | Crouch | A41F 15/02 450/86 |
| 2011/0230120 | A1 | 9/2011 | Tully et al. | |
| 2011/0269376 | A1 * | 11/2011 | Clim | A41F 15/00 450/86 |
| 2012/0324631 | A1 | 12/2012 | Peper et al. | |
| 2013/0254977 | A1 | 10/2013 | Crouch | |

* cited by examiner

GARMENT SYSTEM FOR INTERCHANGEABLE COVERS FOR GARMENT STRAPS

CROSS-REFERENCE TO RELATED APPLICATIONS

The present application is a continuation-in-part of U.S. application Ser. No. 14/479,505, titled "Garment System for Interchangeable Covers for Garment Straps", filed on Sep. 8, 2014, now abandoned, which is a continuation-in-part of U.S. application Ser. No. 13/728,690 titled "Garment System for Interchangeable Covers for Garment Straps", filed on Dec. 27, 2012, now abandoned, which claimed a priority benefit to U.S. Provisional Application No. 61/580,694, filed Dec. 28, 2011. The foregoing disclosures are expressly incorporated by reference herein in their entireties.

FIELD OF THE INVENTION

The present system relates to a cover that overlays a strap of an article of clothing and more specifically, embodiments of an underlying garment with an interchangeable designer cover that fastens to an outer surface of a garment strap.

BACKGROUND OF THE INVENTION

Articles of clothing for women include various types of sleeveless clothes including bras, dresses, lingerie, shirts, tank tops, halter tops and pants that include straps. The phrase "article of clothing" should be interpreted broadly to include those items set forth above and including blouses, skirts, and pants. Other types of articles of clothing include those having belt loops or other straps that may engage the body of a wearer. The strap cover may be modified to fit belt loops and other straps.

In modern society, some consider it unsightly for a woman to wear an article of clothing that reveals her bra strap. Thus, various types of bras are provided in the marketplace. Some of these bras include strapless versions of bras or bras having removable straps to be worn with sleeveless or even strapless garments. However, often these bras can be costly as well as uncomfortable for the wearer. Thus, a cover concealing and decorating the bra straps would make their display more acceptable.

In modern society there is also a fashion trend of garments that purposefully reveal a woman's bra straps. Here, the wearer of the bra often has to purchase numerous bras of different color and design. This can be costly and the straps of each bra may still resemble a bra strap instead of a decorative article of clothing.

What is needed is a system and method for providing garments that have the ability to interchangeably integrate designer straps with the garment such that the problems identified above are overcome.

SUMMARY OF THE INVENTION

Disclosed is a system for integrating a plurality of designer strap covers with an underlying garment. In any number of embodiments, the system includes an underlying article of clothing comprising at least one garment strap, at least one designer strap cover, and a means for attaching a designer strap cover to an underlying garment strap.

In any number of embodiments, hook-and-loop style fastener tapes cover a top surface of a garment strap as well as a bottom surface of a designer strap (also referred to as an ornamental covering). The corresponding hook-and-loop style fastener tape(s) on the bottom surface of the designer strap allow for the ornamental covering to removably attach to and overlay a garment strap and thereby conceal the garment strap.

In any number of embodiments, the ends of a designer strap cover are rounded such that they are more comfortable for the wearer and do not stick into the wearer. In addition, the designer strap covers are slightly wider than the corresponding garment straps such that the garment straps are not visible once the designer strap covers have been applied. Because the underlying garment of the present invention has been designed to incorporate the designer strap covers, the designer strap covers are easier to apply and remove than previous inventions. Furthermore, the garment straps are still adjustable and the garment can be worn with or without the designer coverings, which is different from previous covering assemblies that cannot be detached from the garment.

In any number of embodiments, the underlying garment is a padded bra, wherein a thin layer of material covers the padded bra cups. At the top of each cup where a garment strap attaches to the cup portion of the bra, there is a small opening in the thin layer of material covering the padded bra cup. This opening forms a pocket (also referred to as a pouch) such that the end of a designer strap can be inserted into the opening, thereby resting between the thin layer of material and the padded bra cup. This creates a more secure and aesthetically pleasing fit between the bra and the designer cover. Alternatively, the top of each cup where a garment strap attaches to a cup portion of a bra can be covered with hook-and-loop style fastener tape such that a designer cover can be secured to the cup portion of the bra as well as to a bra strap. Again, this allows for a more secure fit. Alternatively, in embodiments that use the variously-described alternative attachment systems for securing the strap cover to the bra strap, the top of each cup where a garment strap attaches to a cup portion of a bra can include one or more female-sided snap fasteners, one or more openings each of which is configured to receive a button and/or a magnet, and one or more magnets sewn into the fabric of the cup.

In any number of embodiments, the underlying garment is a bra including two over-the-shoulder bra straps. Soft, flexible "stretchy" fastener tapes cover a top surface of the garment straps. Designer covers include corresponding "stretchy" fastener tapes on their bottom surface to permit the covers to be removably attached to an overlay and thereby conceal the garment straps. The elasticity of the underlying tapes or base of these "stretchy" fasteners provides an increase in comfort for the wearer as compared to other fastening mechanisms as well as solving the "bunching" issue. As an elastic bra strap is worn, the strap length will elongate and retract to accommodate the movement of the wearer. When a non-elastic or substantially less-elastic cover is attached to an elastic strap, as the strap extends and retracts the cover will fail to extend and retract with the strap. As a result, the cover can detach from the strap in intervals and fail to re-attach, resulting in a "bunching" of the cover. Bunching occurs where there is visible discontinuity in the attachment of the strap to the cover. For example, the discontinuity in attachment may be seen as the cover forming an arc above the strap between the remaining points of attachment. Bunching" of the cover is unsightly, allows the underlying garment strap to be seen, and draws attention to the underlying garment strap. Furthermore, fasteners such as hook-and-loop style fastener tapes, snaps, magnets and buttons are preferred over adhesives as adhesives can stiffen the cover and garment straps such that they fail to extend, retract, or bend with the movement of the wearer causing discomfort and increasing the likelihood that the garment strap and cover will slide off of the shoulder of the wearer.

Some embodiments of the present approach are directed to bra strap cover systems having a bra with at least one shoulder strap, said at least one shoulder strap having a top surface, a bottom surface, a strap length, and a strap width. The top surface of the at least one shoulder strap may include or support a plurality of first fastener halves that are disposed along the strap length. At least one bra strap cover may be included, with the cover having a decorative upper face, a lower face, a cover length, and a cover width. The lower face of the cover may include a plurality of second fastener halves disposed along the cover length. In this way, the bra strap is configured to be removably attached to the shoulder strap by mating or engaging the plurality of first and second fastener halves together. The cover width may be greater than the strap width and, advantageously, for a given stress, the bra strap cover may have a relative strain of 0.1 or greater, relative to the shoulder strap. The bra strap cover substantially covers and overlies the top surface of said shoulder strap, so that the decorative upper surface may be displayed by the wearer, and the relative strain prevents the cover from bunching.

As noted, the plurality of first and second fastener halves mate to form fasteners. Such fasteners may be selected from the group consisting of male and female snap fasteners, magnets, buttons and button holes, clasp halves, buttons and loops, hook and loop style fastener tape, hooks and eyes, and combinations thereof. The plurality of first and second fastener halves may also be stretchy loop-style fastener tape.

Other embodiments of the present approach may be directed to a bra strap cover system having a bra comprising at least one shoulder strap, with the at least one shoulder strap having a top surface, a bottom surface, a strap length, and a strap width. A first set of magnets disposed along the strap length of the bra shoulder strap. At least one bra strap cover may be included, with the cover having a decorative upper face, a lower face, a cover length, and a cover width. A second set of magnets disposed along the cover length, and the cover width may be greater than the strap width. The second set of magnets may be complementary to the first set of magnets, so that the bra strap is configured to be removably attached to the shoulder strap by mating the first set of magnets with the second set of magnets. In this manner, the bra strap cover substantially covers and overlies the top surface of said shoulder strap. Optionally, the shoulder strap may define or include a plurality of openings disposed along said cover length, with the first set of magnets being disposed within the plurality of openings. The second set of magnets may be disposed along the lower face of said at least one bra strap cover. In some embodiments, the at least one shoulder strap may define a strap interior; the strap cover may define a cover interior, and the first set of magnets may be sewn into the strap interior and the second set of magnets may be sewn into the cover interior. For such embodiments, for a given stress, the at least one bra strap cover may be selected of a material such that it exhibits a relative strain of 0.1 or greater, relative to the at least one shoulder strap.

Other embodiments of the present approach may extend to a bra strap cover system having a bra with at least one shoulder strap, and the shoulder strap having a top surface, a bottom surface, a strap length, and a strap width. The shoulder strap may have a plurality of openings disposed along said strap length. Included is at least one bra strap cover having a decorative upper face, a lower face, a cover length, and a cover width. The cover width may be greater than said strap width. The cover lower face may include a plurality of buttons attached thereto along said cover length. The bra strap may be thus configured to be removably attached to the shoulder strap by engaging or mating the plurality of buttons with the plurality of openings. Attached in this manner, the bra strap cover may substantially cover and overlie the top surface of said shoulder strap. Optionally, for a given stress, the at least one bra strap cover has a relative strain of 0.1, relative to the at least one shoulder strap.

Other embodiments of the present approach may include a bra strap cover system having a first and a second snap fastener tape. The first and second snap fastener tape may be configured to attach to each other by a plurality of male and female snap fasteners disposed on the first and second snap fastener tape. Optionally, the first and second snap fastener tape is elastic. Included is a bra and a bra strap cover. The bra may have at least one shoulder strap, at least one body strap, and at least one cup, with the shoulder strap having a top surface, a bottom surface, a strap length, and a strap width, where the upper side of said at least one shoulder strap includes the first snap fastener tape attached thereto. The cover may have a decorative upper face, a lower face, a cover length, and a cover width, said lower face having the second snap fastener tape attached thereto and extending along said cover length. The cover width may be greater than said strap width. A first end of the bra strap cover may be configured to be attached to a top portion of said cup, a second end of said bra strap cover may be configured to be attached to the rear portion of said body strap, and an intermediate portion of said bra strap cover may be configured to be attached to said shoulder strap such that the bra strap cover substantially covers and overlies the top surface of said shoulder strap. Optionally, for a given stress, the at least one bra strap cover has a relative strain of 0.1 or greater, relative to the at least one shoulder strap.

Other embodiments may be a bra strap cover system having a first and a second hook-and-loop fastener tape, with the first and second hook-and-loop fastener tape configured to attach to each other by a plurality of hooks and loops disposed on the first and second hook-and-loop fastener tape. Included are a bra and a bra strap cover. The bra may have at least one shoulder strap, at least one body strap, and at least one cup, said at least one shoulder strap having a top surface, a bottom surface, a strap length, and a strap width, where the upper side of the shoulder strap includes the first hook-and-loop fastener tape attached thereto. The at least one bra strap cover may have a decorative upper face, a lower face, a cover length, and a cover width. The lower face may have the second hook-and-loop fastener tape attached thereto and extending along said cover length, with said cover width being greater than said strap width. A first end of the bra strap cover may be configured to be attached to a top portion of said cup, a second end of said bra strap cover may be configured to be attached to said rear portion of the body strap, and an intermediate portion of the bra strap cover may be configured to be attached to said shoulder strap such that the bra strap cover substantially covers and overlies the top surface of said shoulder strap. Optionally, the first and second hook-and-loop fastener tapes are elastic and for a given stress, the at least one bra strap cover has a relative strain of 0.1 or greater, relative to the at least one shoulder strap.

DETAILED DESCRIPTION

Figure 1A:
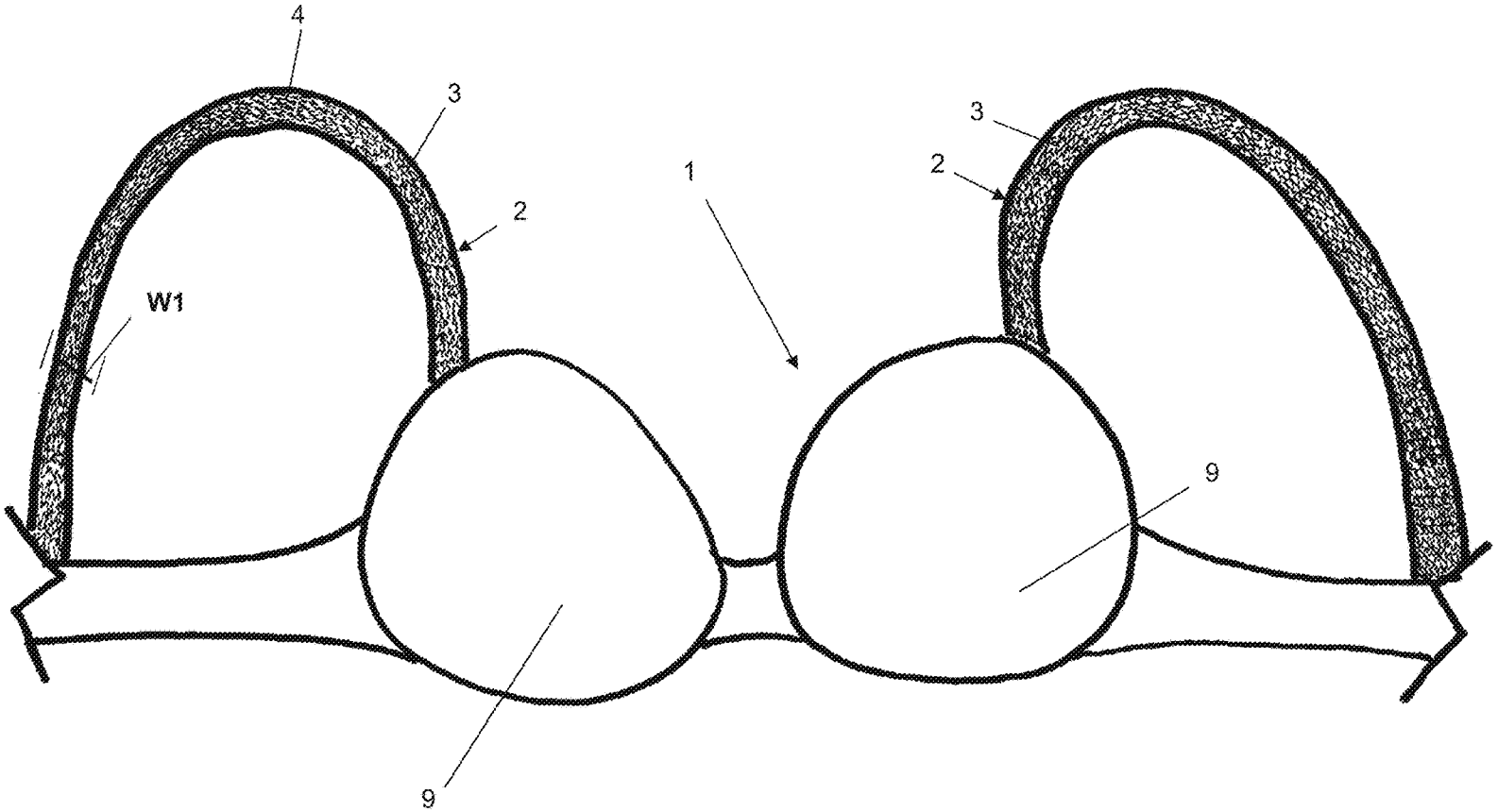
FIG. 1A is a front perspective view of a front side of an underlying garment, and FIG. 1B includes garment straps wherein a top surface of each garment strap is covered by hook-and-loop style fastener tape according to an embodiment of the present invention.

Disclosed is a system for integrating a plurality of designer strap covers with an underlying garment, such as a bra. In any number of embodiments, the present invention includes an underlying article of clothing 1 comprising at least one garment strap 2; at least one designer strap cover (also referred to as an ornamental covering) 6; and a means or device 4 for attaching the designer strap cover to the underlying garment or bra shoulder strap 2.

As shown in FIGS. 1A through 2B, for example, a garment strap 2 has a width W1 and a length L1. A designer strap cover 6 has a width W2 and a length L2. In these figures, length L2 is substantially equal to or slightly longer than L1. Width W2 is substantially equal to or slightly wider than W1. At least one strip of hook-and-loop style fastener tape 4 covers a top surface of a garment strap 3 as well as a bottom surface 8 of a designer strap cover 6. If W2 is larger than W1, it is contemplated that the strip(s) of hook-and-loop style fastener tape 4 do not cover the entire bottom surface 8 of the designer strap cover 6, but instead only cover a portion equal in width to W1.

Figure 3A:
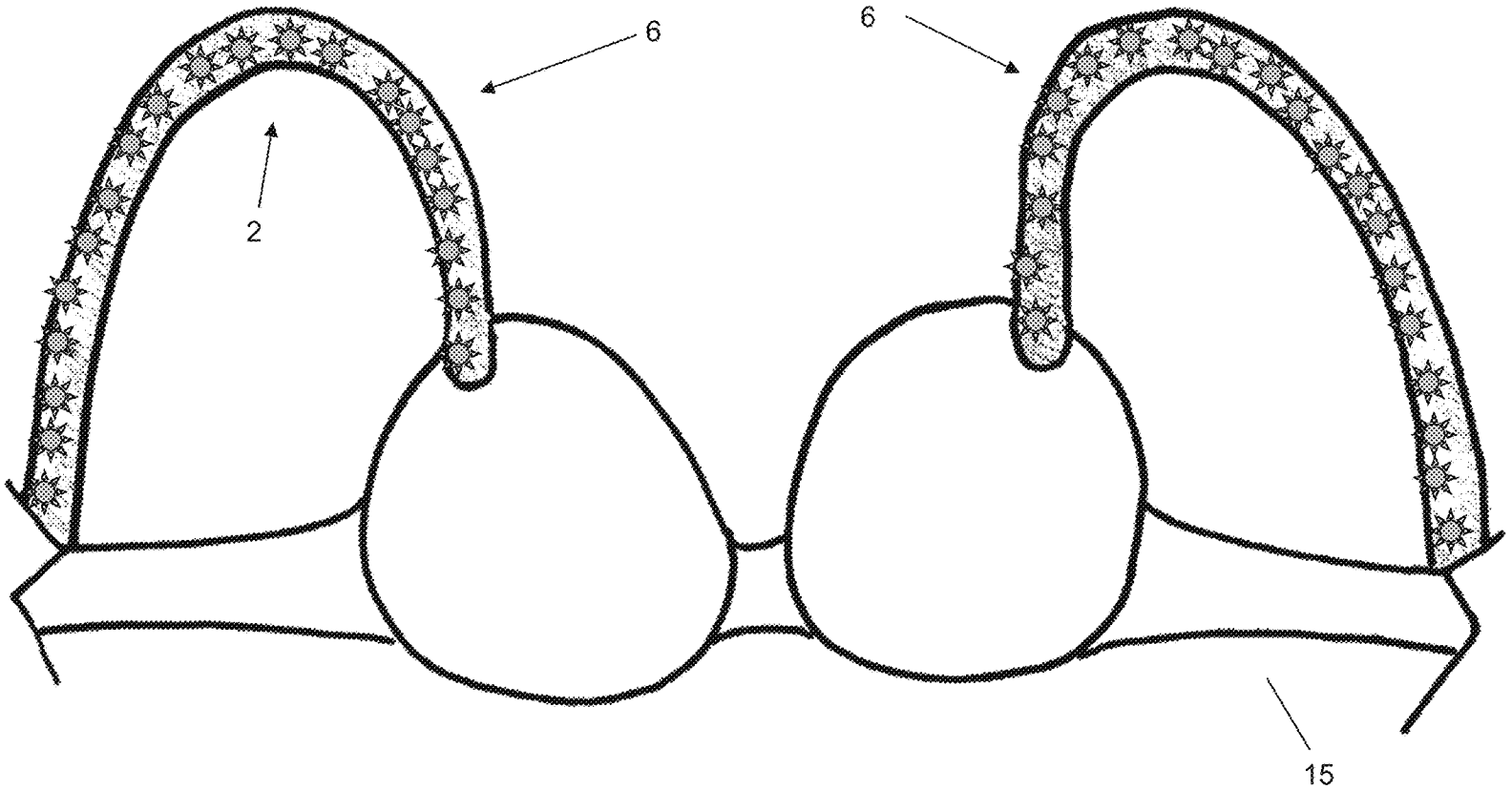
FIG. 3A is a front perspective view of an underlying garment wherein a designer strap cover is attached to each garment strap according to an embodiment of the present invention.
Figure 3B:
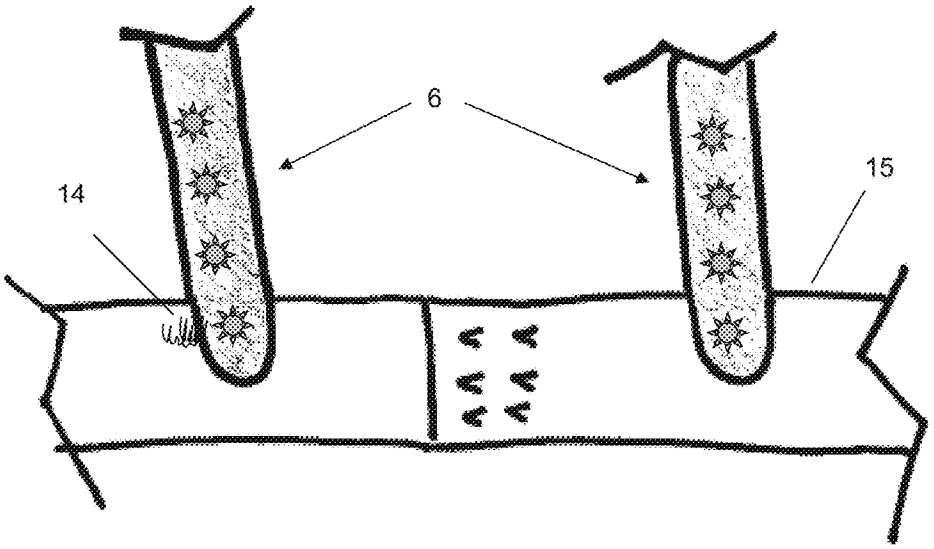
FIG. 3B is a front perspective view of the back side of the underlying garment of FIG. 3A wherein a designer strap cover is attached to each garment strap.

The corresponding strip(s) of hook-and-loop style fastener tape 4 on the bottom surface 8 of the designer strap cover 6 allow for the ornamental covering to removably engage with or attach to and overlay a garment strap 2 such that an ornamental top surface 7 of the designer strap cover 6 is displayed and further conceals the garment strap 2, as shown in FIGS. 3A and 3B. Any number of colors or patterns may be incorporated on a designer strap cover 6, thereby allowing for a wearer to utilize any number of colors and styles with a single underlying garment piece. In addition, such elements may be made from any one of variety of fabrics or materials, so long as the performance requirements are suited to the application and the parameters claimed herein.

Figure 1B:
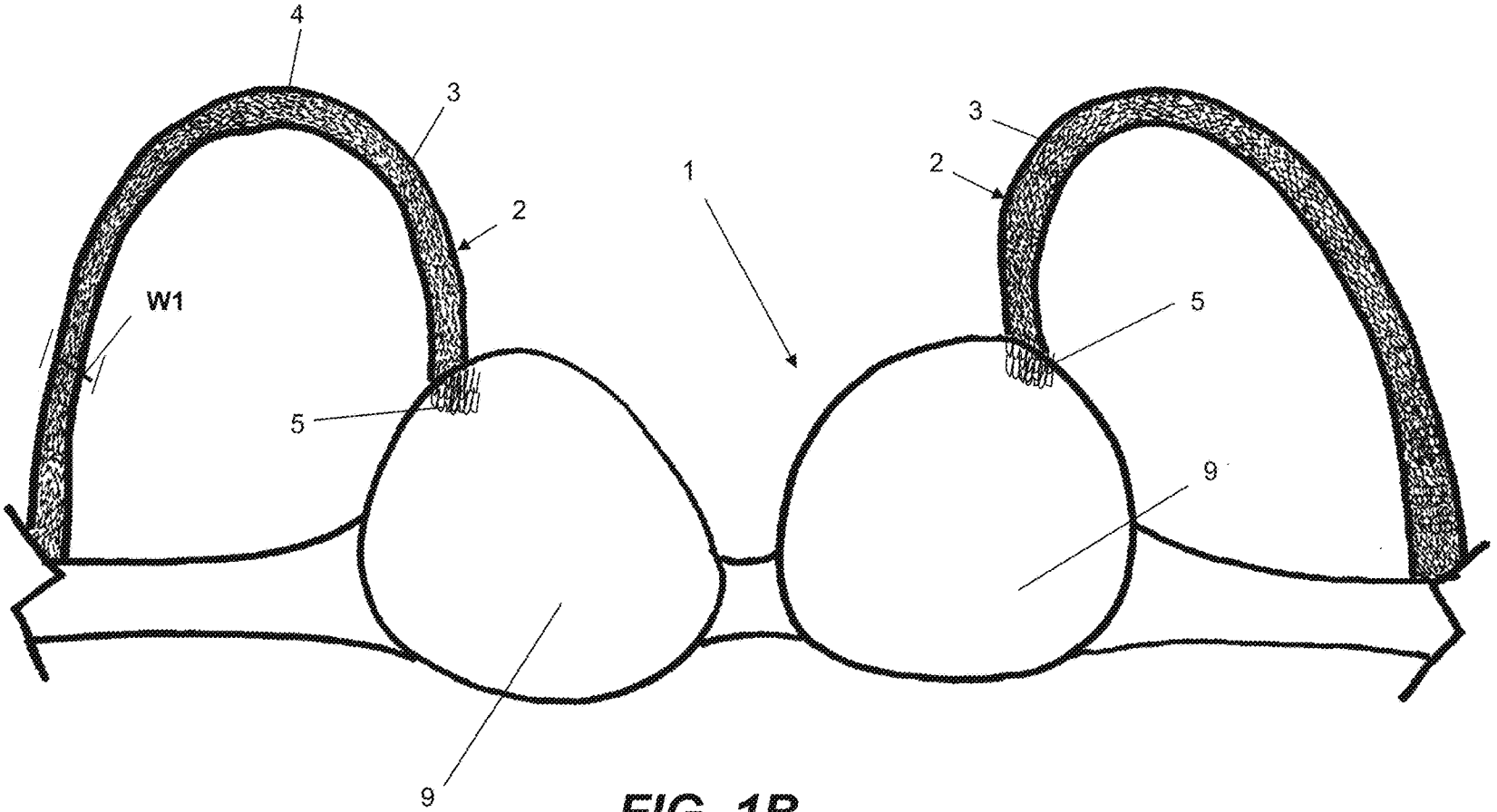
Figure 2A:
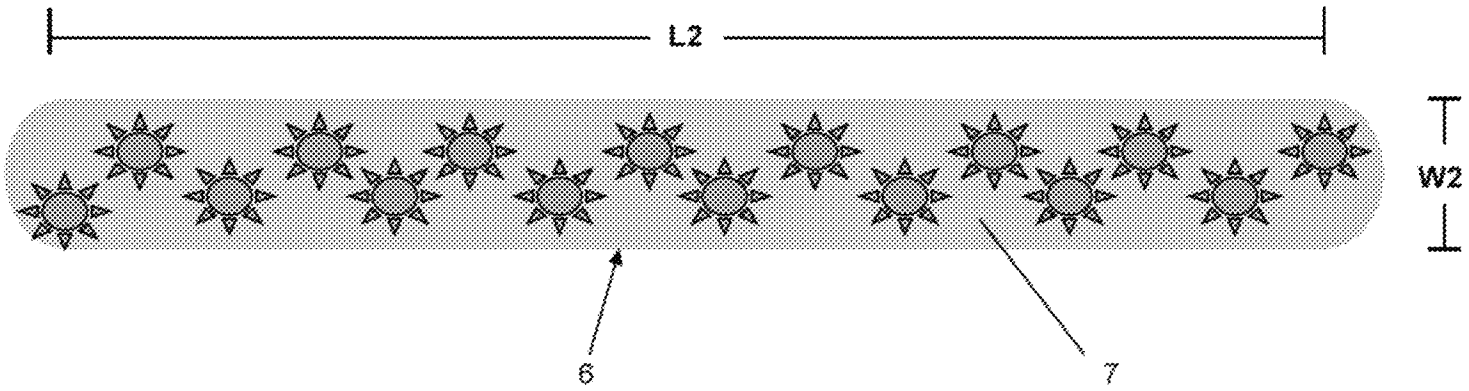
FIG. 2A is a front perspective view of a top surface of a designer strap cover according to an embodiment of the present invention.
Figure 2B:
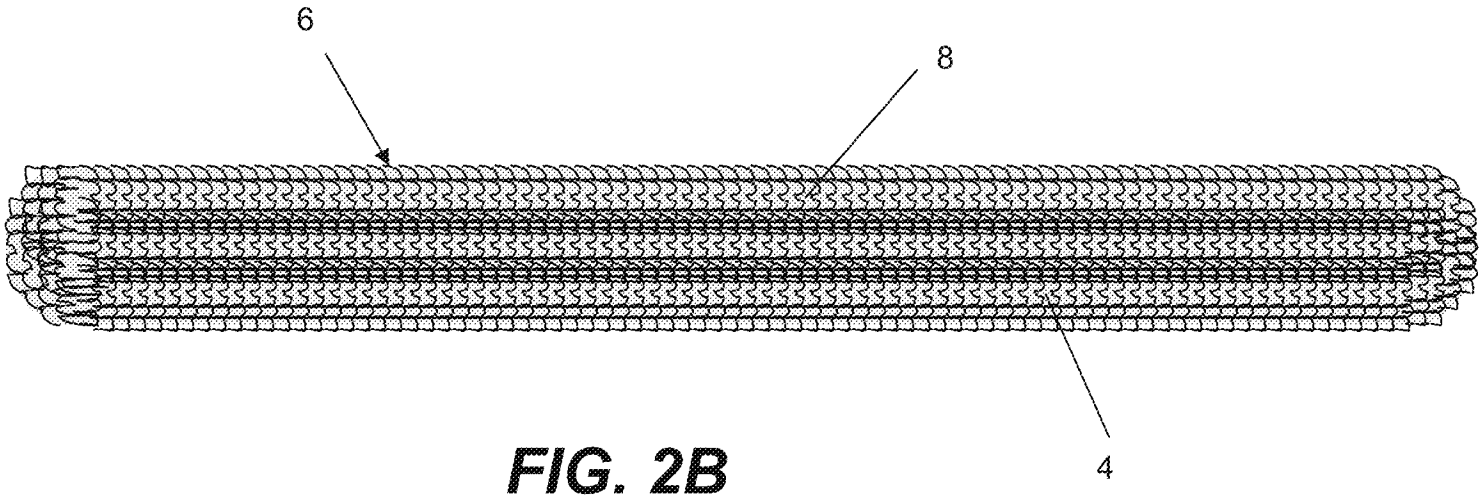
FIG. 2B is a front perspective view of a bottom surface of the designer strap cover of FIG. 2A.

As shown in FIGS. 2A and 2B, for example, the ends of a designer strap cover 6 may be rounded to be more comfortable for the wearer and to avoid sticking into the wearer. In addition, as shown in FIGS. 3A and 3B, for example, the designer strap covers 6 may be slightly wider than the corresponding garment straps 2 such that the garment straps are not visible once the designer strap covers have been applied. Furthermore, as shown in FIG. 1B for example, optional strip(s) of hook-and-loop style fastener tape (or other means for attachment) 5 may be included on the upper portion of a bra cup 9 just below the place that a garment strap 2 attaches to the underlying garment 1. As shown in FIG. 3A, if the length L2 of a designer strap cover 6 is slightly longer than the length L1 of a corresponding garment strap 2, then the extra length of the designer strap cover can attach to the optional strip of hook-and-loop style fastener tape 5 on the bra cup 9 and provide additional security for the installed cover. As shown in FIG. 3B, for example, any additional length of designer strap cover 6 may be attached to the strip of hook-and-loop style fastener tape 14 on the back of the body straps 15 of the underlying bra.

Because an underlying garment 1 of the present invention has been designed to incorporate the designer strap covers, the designer strap covers 6 are easier to apply and remove than with conventional or prior approaches. Furthermore, the garment straps 2 are still adjustable and the garment can be worn with or without the designer coverings, which is different from previous covering assemblies that cannot be detached from the garment. It may be preferable for strip(s) of the softer hook-and-loop style fastener tape 4 to be applied to the top surface 3 of the underlying garment straps such that in the case where a wearer chooses not to utilize a designer cover 6, the underlying garment is not uncomfortable to wear.

In some embodiments, stretchy hook-and-loop style fastener tape may be the device 4 for attaching the designer strap cover to the underlying garment or bra shoulder strap 2. In other cases, device 4 may be a plurality of other fasteners, such as a plurality of first and second fastener halves adapted to mate or engage together. The plurality of first and second fastener halves may mate to form fasteners such as (male and female) snap fasteners, attracting/engaging magnets, buttons and button holes, clasp halves, buttons and loops, hook and loop style fastener tape, hooks and eyes, and combinations thereof. In some embodiments, the fasteners may be: 1) stretchy snap tape—wherein an elastic fabric base further comprises female-sided or male-sided snaps disposed at intervals along its length; or 2) stretchy button tape—wherein an elastic fabric base further comprises buttons or openings to receive buttons at intervals along its length. Specifically, stretchy female-sided snap fastener tape or stretchy button-opening-style fastener tape may be employed in any of the described embodiments, for example, as an alternate fastening approach to embodiments described using stretchy loop-style fastener tape. Several embodiments may use such alternatives for the elastic qualities which reduce bunching and slipping problems described above and increase the comfort of the wearer.

Figure 4:
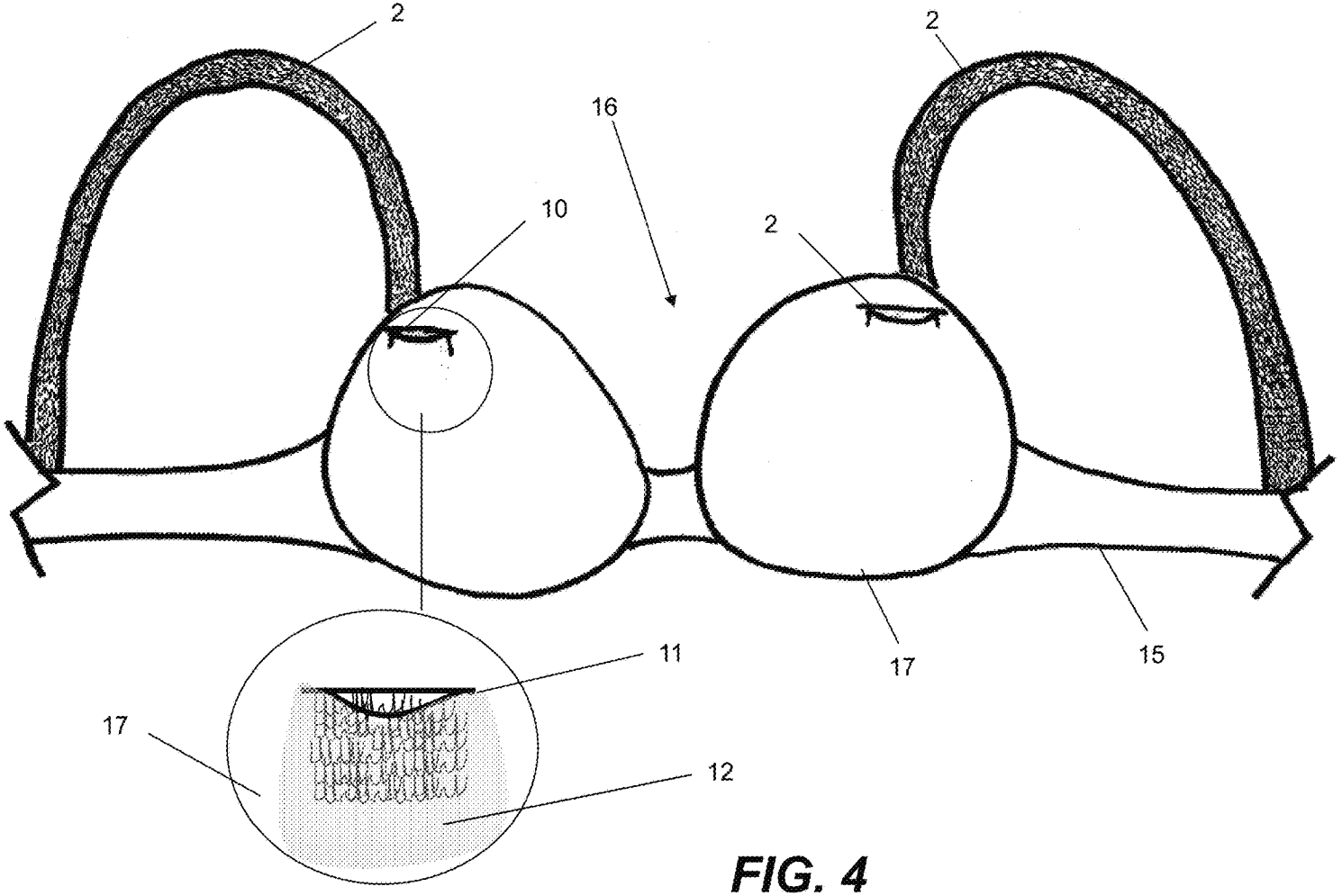
FIG. 4 is a front perspective view of a padded bra including a front opening for receiving a designer strap cover according to an embodiment of the present invention.
Figure 5A:
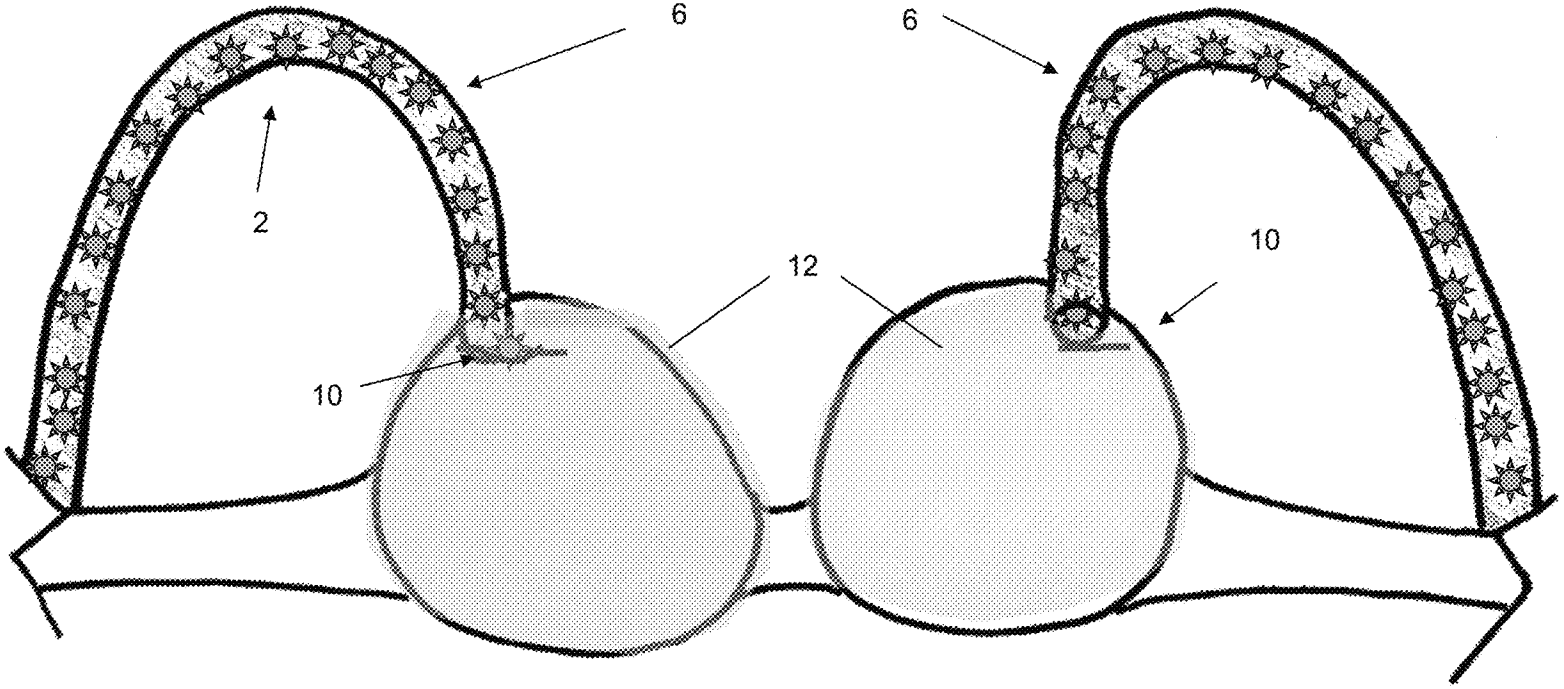
FIG. 5A is a front perspective view of a front side of the padded bra of FIG. 4 with a designer strap cover attached to each garment strap.
Figure 5B:
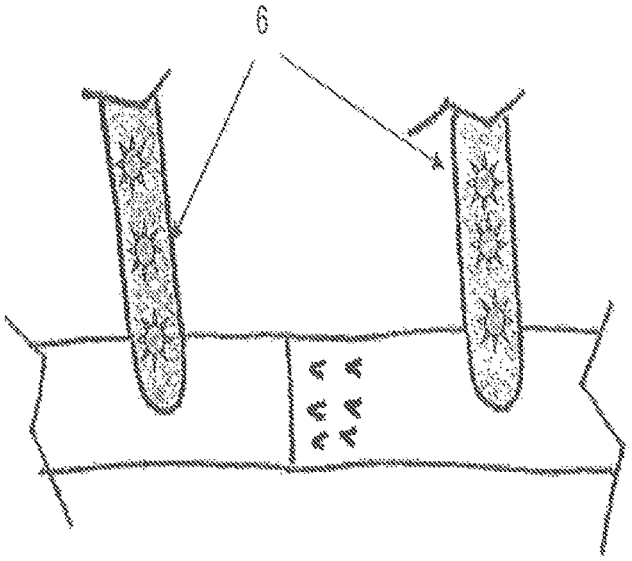
FIG. 5B is a front perspective view of a back side of the padded bra of FIG. 4 with a designer strap cover attached to each garment strap.

In any number of embodiments where the underlying garment may be a padded bra 16, as shown in FIG. 4 for example, a thin layer of material 12 may cover the padded bra cups 17. At the top of each cup 17 where a garment strap 2 attaches to the cup portion 17 of the bra, there is a small opening 10 in the thin layer of material 12 covering the padded bra cup 17. This opening 10 receives the end of a designer covering 6, as shown in FIG. 5A for example. As shown in FIG. 4, for example, hook-and-loop style fastener tape(s) (or other means of attachment) 11 lie on the surface of the padded bra cup 17 just below the opening 10 in the exterior material 12. The corresponding hook-and-loop style fastener tape(s) on the back surface 8 of a designer cover 6 can removably attach to these hook-and-loop style fastener tape(s) 11. This creates a more secure and aesthetically pleasing fit between the bra and the designer cover. As shown in FIG. 5A, for example, the length L2 of a designer strap cover 6 may be slightly longer than the length L1 of a garment strap 2, such that the extra length of a designer cover 6 can be secured or tucked into the opening 10 in the exterior material 12 covering the padded bra cup 17. Alternatively, the top of each cup where a strap attaches to a cup portion of a bra can be covered with hook-and-loop style fastener tape(s) such that a designer cover can be secured to the cup portion of the bra as well as to a bra strap, as shown in FIG. 3A, for example. Again, this allows for a more secure fit. It is also contemplated that in some embodiments an opening may exist or be defined by material on the back of the body straps 15 of the underlying garment such that the designer covers can also tuck into the back of the bra.

Figure 6A:
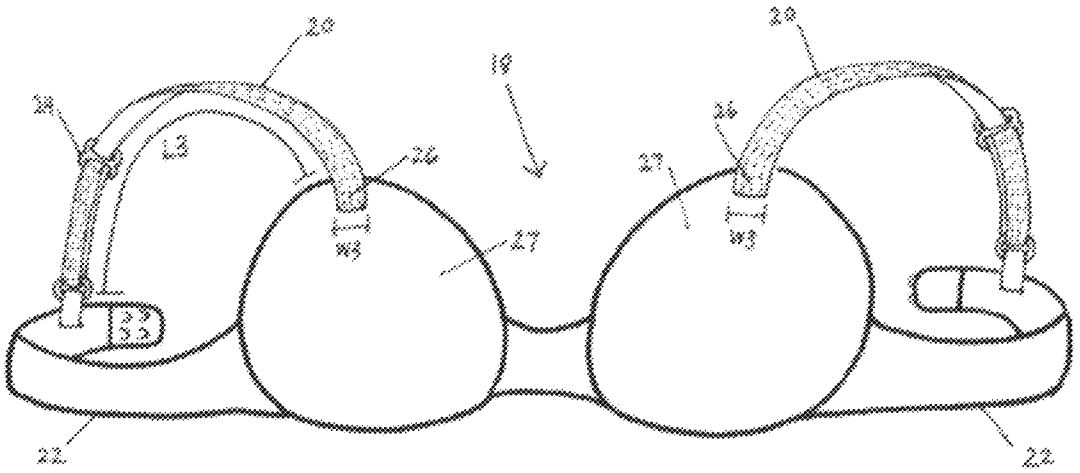
FIG. 6A is a front perspective view of a front side of a bra including bra straps wherein a top surface of each garment strap is covered by stretchy loop-style fastener tape according to an embodiment of the present invention.
Figure 6B:
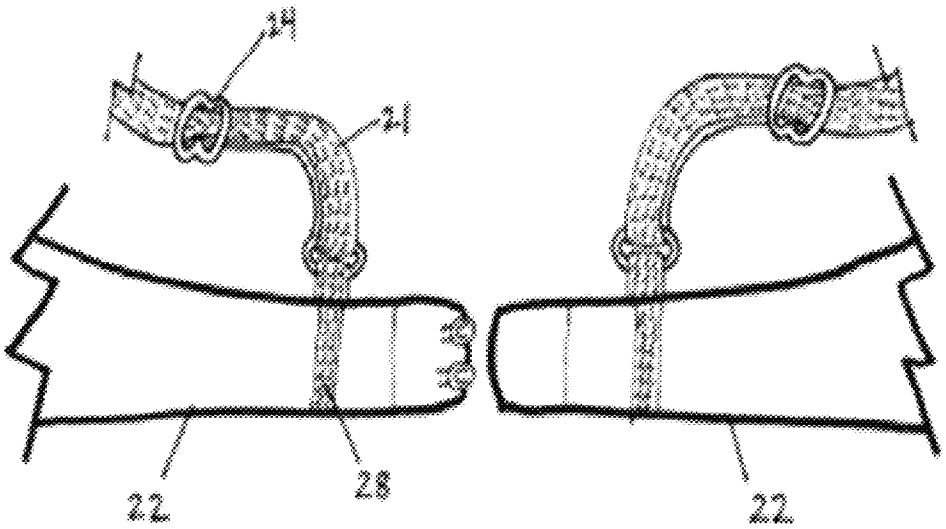
FIG. 6B is a front perspective view of a back side of the bra of FIG. 5A.
Figure 8:
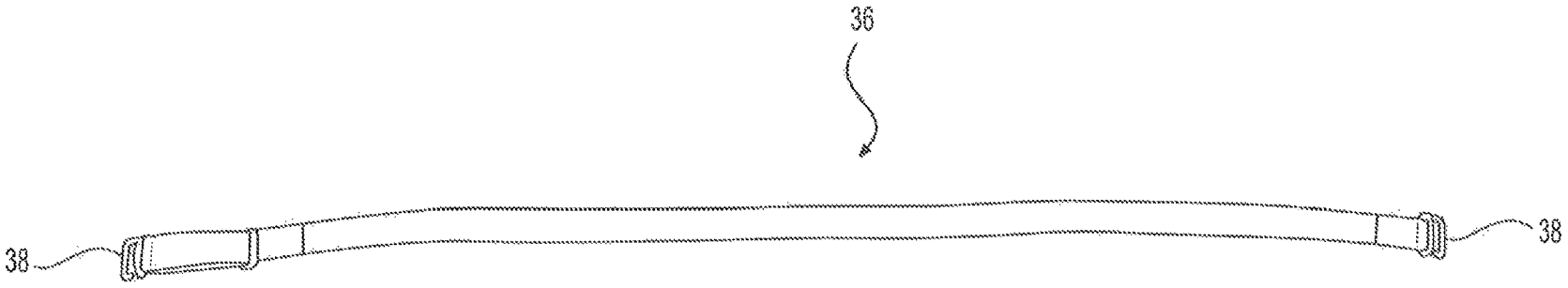
FIG. 8 is a front perspective view of a detachable bra strap according to an embodiment of the present invention.

FIGS. 6A and 6B show a bra 18 according to one embodiment of the present invention. Bra 18 may be any of a variety of embodiments of bra, including for example a sports bra, and may be similar in many or all respects to the bra embodiments previously described. Bra 18 may include adjustable shoulder straps 20. In any number of alternative embodiments, shoulder straps 20 may be detachable to permit bra 18 to become a strapless bra, as shown in FIG. 8. Straps 20 may have a width W3 and a length L3.

As discussed above, some embodiments may address the problems of bunching by relative elastic covers 6 to enable cover strain as an elastic shoulder strap is strained for a given level of tensile stress caused by the movement of the wearer. In certain of such embodiments, the top surfaces of shoulder straps may be covered by a strip of soft, flexible, elastic or first "stretchy" hook-and-loop-style fastener tape(s) 21 (FIG. 6B), e.g. of the type sold by Velcro USA, Inc. (also referred to in short as "stretchy loop-style fastener tape). However, it is contemplated that a plurality of strips of "stretchy" loop style fastener tape may be attached to the top surfaces of the straps within this embodiment. Stretchy loop-style fastener tape would refer to either hook or loop forms, with embodiments intended for engagement. However, it is contemplated that a plurality of strips or segments may be attached to the top surfaces of the straps within this embodiment. The use of this style of fastener on the garment may be desirable to ensure that the straps are not uncomfortable to the wearer and to avoid bunching. In addition, the "stretchy" loop-style fastener tape(s) 21 do not prevent the straps from sliding easily through adjustment clip 24. Thus, the adjustability of bra 18 is not impeded by the fasteners 21. Optionally, a first segment or strip of hook-and-loop-style fastener tape 5 (See FIG. 1B) may be included on the cups 27 at or near the juncture of cups 27 and straps 20. Body straps 22 may include an optional second segment or strip 28 of hook-and-loop-style fastener tape(s) aligned with straps 20. In addition, the straps 20 may be sewn or otherwise fastened to the tops of bra cups 27 such that a portion 26 of the straps (covered with loop-style fasteners) extends onto the cup.

Thus, stretchy loop style fastener tape (or stretchy hook and loop style fastener tape) is intended to enable cover 6 to be elastic and stretchable, while hook-and-loop style fastener tape may or may not be elastic, depending on the embodiment. For clarity, the category of hook-and-loop style fastener tape would include stretchy loop-style fastener tape and non-stretchy or inelastic hook-and-loop style tape. However, stretchy loop style fastener tape would not include inelastic hook-and-loop style tape.

Embodiments of elastic covers 6 or shoulder straps 3 may include inelastic hook-and-loop style tape, so long as (i) the inelastic hook-and-loop style tape does not impair the overall elasticity of the cover or shoulder strap, such as by use of multiple, separate segments (see, e.g., FIG. 9), and (ii) corresponding hook-and-loop style tape on the cover and shoulder strap are configured to correspond or engage even in a condition of strain. FIG. 9 illustrates cover 6 under no stress, with shorter length L1, and an applied stress with longer length L2, showing elasticity and strain. An elastic shoulder strap would behave similarly. The separated segments of hook-and-loop style tape 4 would permit strain of cover 6 between the segments. For comparison, FIG. 10 and FIG. 11 illustrate stretchy loop style fastener tape 21 under no stress, with shorter length L1, and under a given applied stress strained to a longer length L2.

The use of elastic or stretchable strap covers 6 may avoid or solve the bunching experienced with inelastic materials when used with elastic shoulder straps 20. As noted above, bunching is a discontinuity between an inelastic form of strap cover and an elastic form of shoulder strap 20; conventional strap covers and strap cover fasteners are substantially inelastic. Young's modulus (E) can provide a measure of elasticity. Young's modulus represents the linear elasticity of a material when placed under a given stress. Young's modulus (E) is calculated by dividing the tensile stress by the extensional strain in the material, e.g. the change in the length divided by the initial length.

$$E=(F/A_0)/(\Delta L/L_0)=(\text{Force/Area})/(\text{Change in Length/Initial Length})$$

For a consistent or given stress or force over area, Young's modulus is inversely related to the strain. In other words, the modulus decreases with an increase in elasticity. Substantial differences in relative strain performance at a given stress can contribute to the problem of bunching.

There is considerable variability in the characteristics of materials used in the manufacture of garments and their fasteners. Table 1 shows relative elasticity information for four sample elastic straps (Straps 1-4) and one substantially inelastic sample strap (Strap 5), as various straps were tested with 160 psi applied in axial tension. While strap 60 might have elasticity or strain characteristics of any of the samples among Straps 1-4, for example. Strap 3 in particular was a sample of stretchy loop style fastener tape. Relative values were calculated based on the most elastic (Strap 1) of these sample Straps 1-4 among a variety of strap materials $$\left(\varepsilon_{rel}=\frac{\varepsilon_{strap\,n}}{\varepsilon_{strap\,1}}\right)$$

with relative Young's modulus E calculated similarly.

| | Strain at 160 psi | Relative Strain (to Strap 1) | Relative E (to Strap 1) |
|---|---|---|---|
| Strap 1 | 2.087 | 1.00 | 1.00 |
| Strap 2 | 1.857 | 0.889 | 1.12 |
| Strap 3 | 0.940 | 0.450 | 2.22 |
| Strap 4 | 0.600 | 0.287 | 3.48 |
| Strap 5 | 0.0526 | 0.025 | 39.65 |

An elastic strap cover (and its fastener) that exhibit greater strain (or elongation) than an associated shoulder strap at a particular stress produced no bunching, in that the elements (cover and strap) formed a single elastic unit when engaged to each other. In addition, various combinations of elastic Straps 1-4 did not bunch when strained, it is believed for the same reason. However, Strap 5 exhibited bunching when used with any of a variety of the above elastic straps. Thus, bunching may be avoided by selecting cover and fastener materials having advantageous relative strain characteristics, which may be considered for a given stress to be a relative strain of 0.1 or greater, or preferably 0.25 or greater, but with 0.025, for example, being dissimilar and relatively inelastic. Thus, "elastic" does not connote a particular fabric, but a performance characteristic evidenced by strain.

In any number of embodiments, shoulder straps 20 may be detachable to permit bra 18 to become a strapless bra (See, e.g., FIG. 8). In such embodiments, one or more hooks, eyes, clasps, or other suitable fastening mechanisms may be included at each end of the each of the shoulder straps 20 to allow for attachment to bra 18. In any number of embodiments, detachable shoulder straps 20 may be configured to attach to an existing convertible strapless bra. In such embodiments, shoulder straps 20 may be manufactured and sold separately to be used on an existing bra. FIG. 8 shows an exemplary embodiment of a detachable shoulder strap 36 that includes hooks 38 at each end for facilitating attachment to a bra.

Figure 7A:
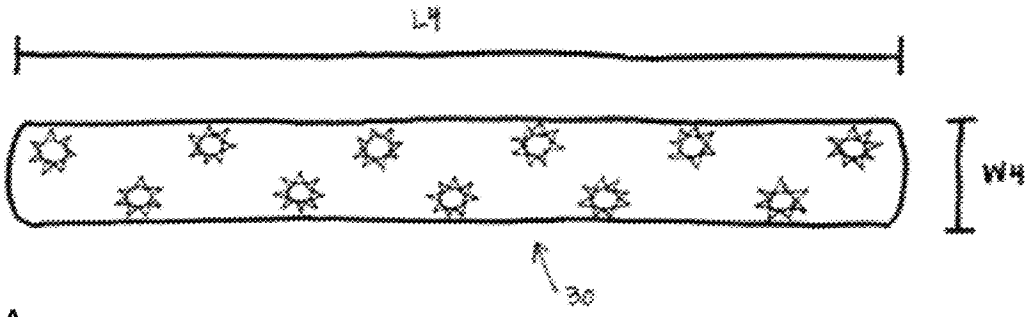
FIG. 7A is a front perspective view of a top surface of a designer strap cover according to an embodiment of the present invention.
Figure 7B:
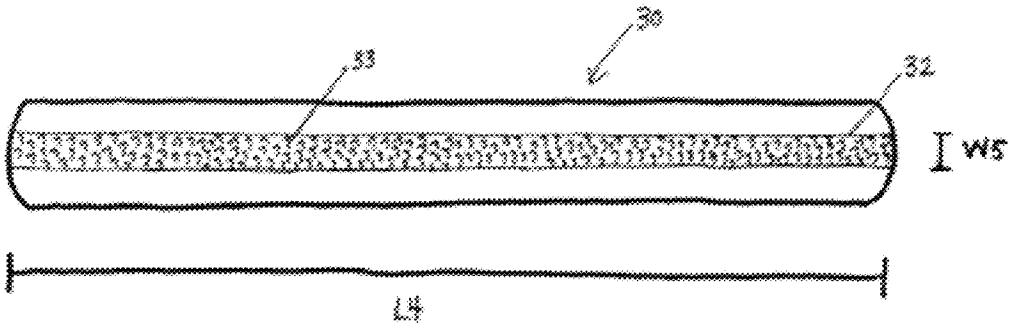
FIG. 7B is a front perspective of a bottom surface of the designer strap cover of FIG. 7A.

FIGS. 7A and 7B show a designer cover according to one embodiment of the present invention. Cover 30 may be similar in many or all respects to the cover embodiments previously described. Cover has a length L4 and a width W4. Length L4 may be substantially the same as, shorter than, or longer than the length L3 of straps 20. Width W4 may be substantially the same as, or preferably slightly wider than, the width W3 of straps 20. Making the width W4 slightly wider than width W3 may be desirable to ensure complete coverage of straps 20. The underside of cover 30 includes at least one first strip 32 of stretchy hook and loop-style fastener tape(s) having a width W5. Width W5 may be substantially the same as the width W3 of straps 20. In a preferred embodiment, width W5 is slightly smaller than width W3. Such an embodiment can be used to ensure that the stretchy hook-and loop style fastener tape(s) 33 do not contact the wearer's skin and cause discomfort. In the illustrated embodiment, strip 32 extends the entire length L3 of the designer cover. However, in other embodiments, strip 32 may extend along only a portion of the cover's length or may be comprised of a plurality of strips or separate segments. Strip 32 may be, for example, a length of "one wrap Velcro" fabric that is secured to the underside of cover 30 with the hook-and-loop style fastener tape(s) side of the strip facing out. In a preferred embodiment, a relatively thin variety of one wrap Velcro is used to avoid cover bulkiness and to allow the cover to rest relatively flat on the wearer's body.

Figure 9A:
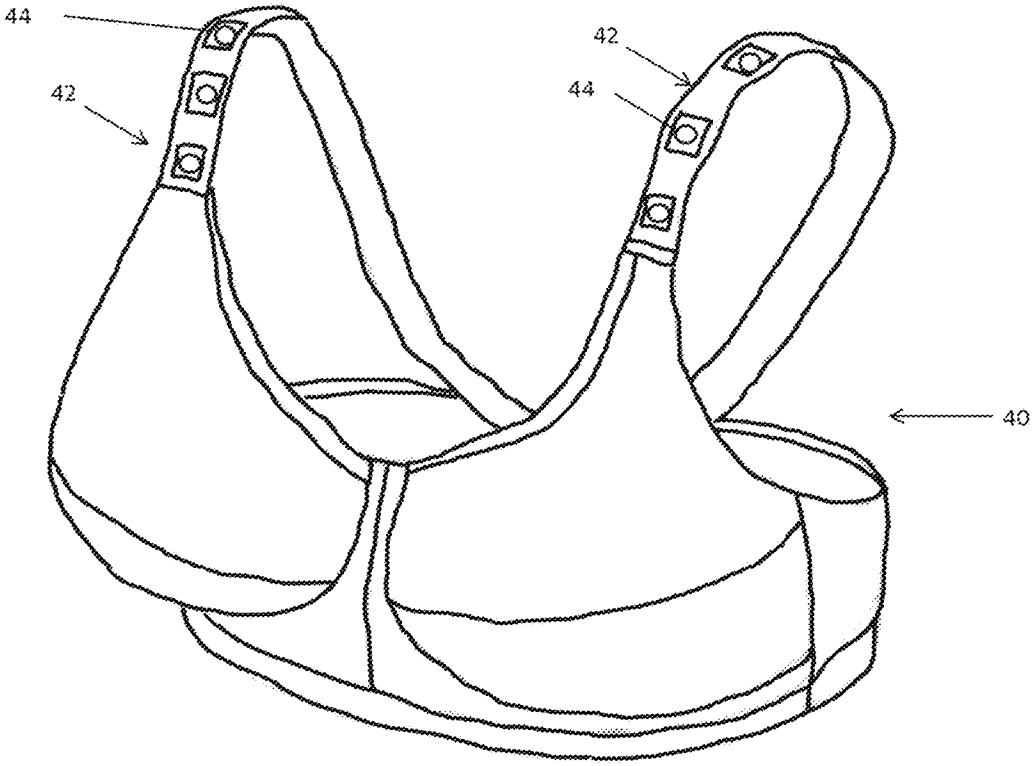
FIG. 9A is a front perspective view of an embodiment of a bra according to the present invention having female-sided snap fasteners along the length of the upper side of the shoulder straps.
Figure 9B:
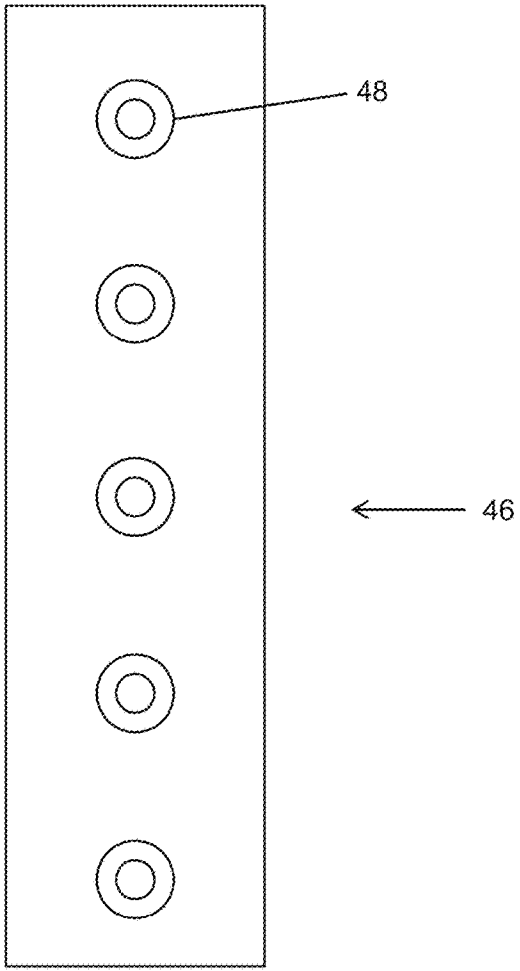
FIG. 9B is a bottom view of an interchangeable garment covering strap for use in connection with the bra of FIG. 9A, the strap having male-sided snap fasteners disposed along the length of its lower side.

FIG. 9A shows a bra 40 according to one embodiment of the present invention. Bra 40 may be similar in many or all respects to the bra embodiments previously described. Bra 40 includes adjustable shoulder straps 42. In this embodiment, a plurality of female-sided snap fasteners (i.e., first fastener halves) 44 may be disposed at intervals along the length of the top surfaces of the shoulder straps 42. The female-sided snap fasteners may be disposed on an elastic tape which comprises or is secured to the top surfaces of the shoulder straps, e.g. as a stretchy snap fastener tape. Bra 40 is configured for use in connection with the interchangeable bra strap cover 46 shown in FIG. 9B. Cover 46 may be similar in many or all respects to the cover embodiments previously described. The bottom surface of cover 46 may have a plurality of male-sided snap fasteners (i.e., second fastener halves) 46 disposed along its length. Male-sided snap fasteners 46 are sized and configured in a manner that permits attachment or mating to the female-sided snap fasteners 44 of bra 40. Male-sided snap fasteners 46 may be disposed at intervals which correspond to the intervals of the female-sided snap fasteners 44 of bra 40 in a manner that permits attachment to the female-sided snap fasteners 44 of bra 40. The male-sided snap fasteners may be disposed on an elastic tape which is secured to the bottom surfaces of the cover. Of course the selection of male or female as first and second fastener halves may be reversed, so long as the snap fasteners may mate. The use of snap fasteners at intervals along the length of the shoulder straps and cover allows for the free movement and use of the elasticity of the shoulder straps and cover (i.e., the relative strain), is such that comfort of the wearer is increased, the shoulder straps and cover are less likely to slip from the shoulder, and "bunching" of the cover is avoided.

In another embodiment, the shoulder straps may include at least one strip of stretchy female-sided snap fastener tape arranged such that the female-sided snaps are arranged on the top surface of the shoulder strap. In this embodiment, the bra may be configured for use with a bra strap cover which may be similar to the cover embodiments previously described. The cover in this embodiment may have at least one strip of stretchy male-sided snap fastener tape disposed along the bottom surface of the cover, the at least one strip of stretchy male-sided snap fastener tape is configured and arranged along the length of the cover in a manner that permits attachment to the at least one strip stretchy female-sided snap fastener tape of the shoulder straps.

Figure 10A:
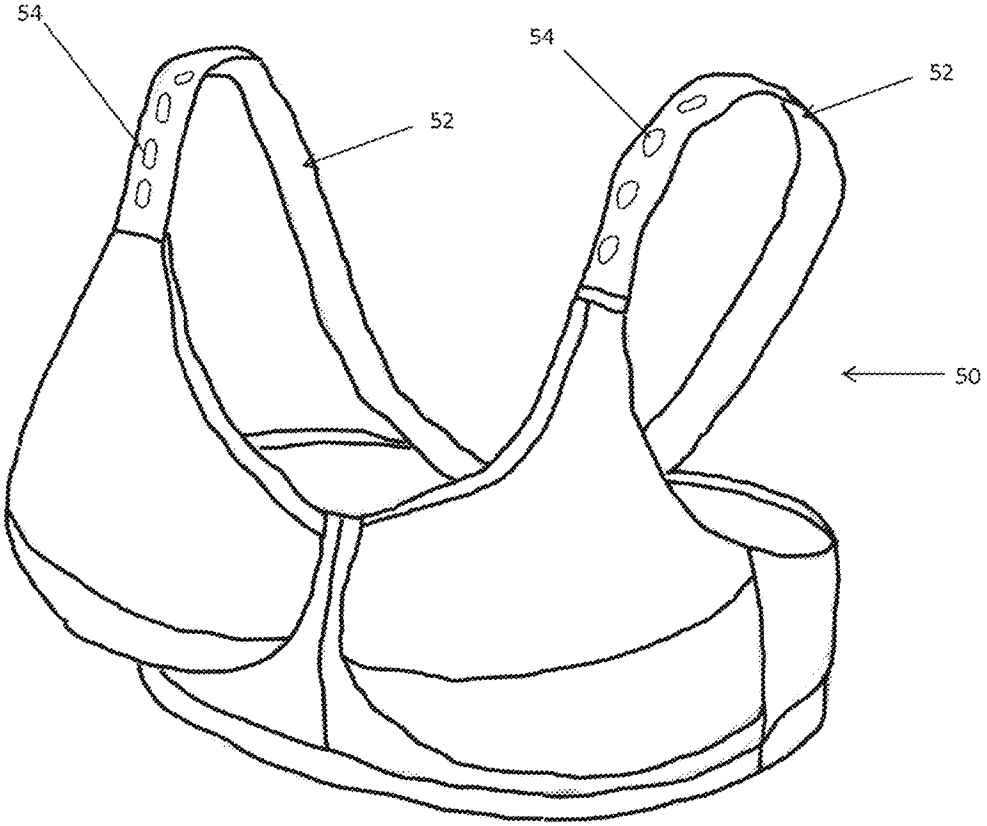
FIG. 10A is a front perspective view of an embodiment of a bra according to the present invention having openings along the length of the shoulder straps in which to receive either buttons or magnets.
Figure 10B:
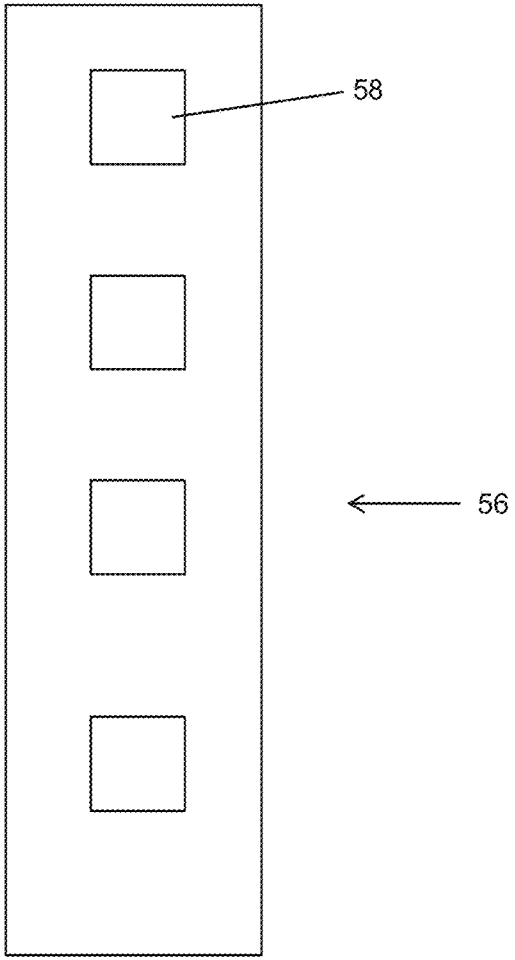
FIG. 10B is a bottom view of an interchangeable garment covering strap for use in connection with the bra of FIG. 10A, the strap having magnets disposed along the length of its lower side.
Figure 10C:
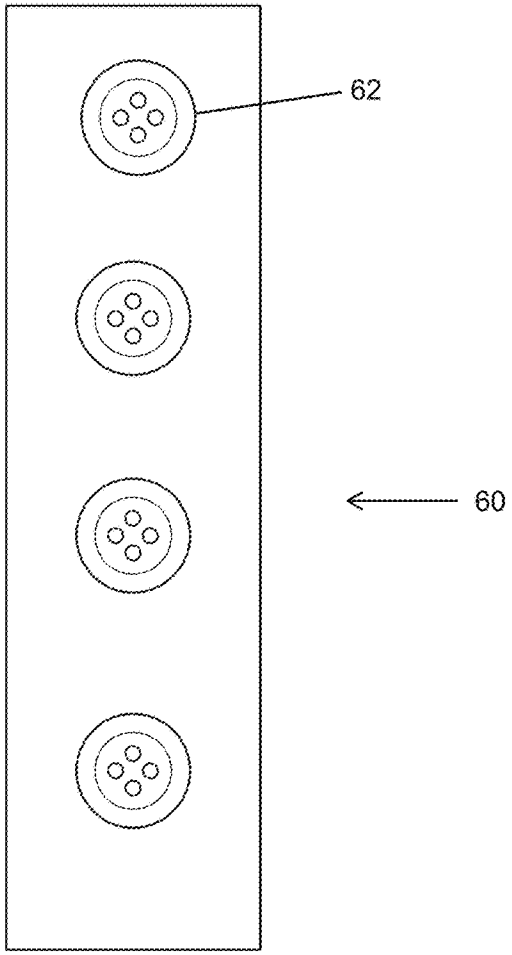
FIG. 10C is a bottom view of an interchangeable garment covering strap for use in connection with the bra of FIG. 10A, the strap having buttons disposed along the length of its lower side.

FIG. 10*a* shows a bra 50 according to one embodiment of the present invention. Bra 50 may be similar in many or all respects to the bra embodiments previously described. Bra 50 includes adjustable shoulder straps 52. In this embodiment, a plurality of openings (i.e., first fastener halves) 54 are disposed at intervals along the length of the top surfaces of the shoulder straps 52. The openings 54 may be configured to receive either buttons and/or magnets. Bra 50 is configured for use in connection with the interchangeable cover 56 shown in FIG. 10*b*. Cover 56 may be similar in many or all respects to the cover embodiments previously described. The bottom surface of cover 56 may have a plurality of magnets (i.e., second fastener halves) 58 disposed at intervals along its length corresponding to the intervals of openings 54 of shoulder straps 52 of bra 50. Magnets 58 may be positively or negatively charged. Magnets 58 are configured to attach or mate to complementary magnets (not shown) disposed in openings 54. Of course, the selection of positive or negative as first and second fastener halves may be reversed, so long as the fasteners may mate. In addition, or in the alternative, bra 50 may be configured for use in connection with interchangeable cover 60 shown in FIG. 10*c*. Cover 60 may be similar in many or all respects to the cover embodiments previously described. The bottom surface of cover 60 may have a plurality of buttons (i.e., second fastener halves) 62 disposed at intervals along its length corresponding to the intervals of openings 54 of shoulder straps 52 of bra 50. Buttons 62 are sized and configured in a manner that permits them to be received in openings 54. Of course, the selection of buttons or button holes as first and second fastener halves may be reversed, so long as the fasteners may mate. The use of buttons and/or magnets at intervals along the length of the shoulder straps and cover allows for the free movement and use of the elasticity of the shoulder straps and cover (i.e., the relative strain), such that comfort of the wearer is increased, the shoulder straps and cover are less likely to slip from the shoulder, and "bunching" of the cover is avoided.

Figure 11A:
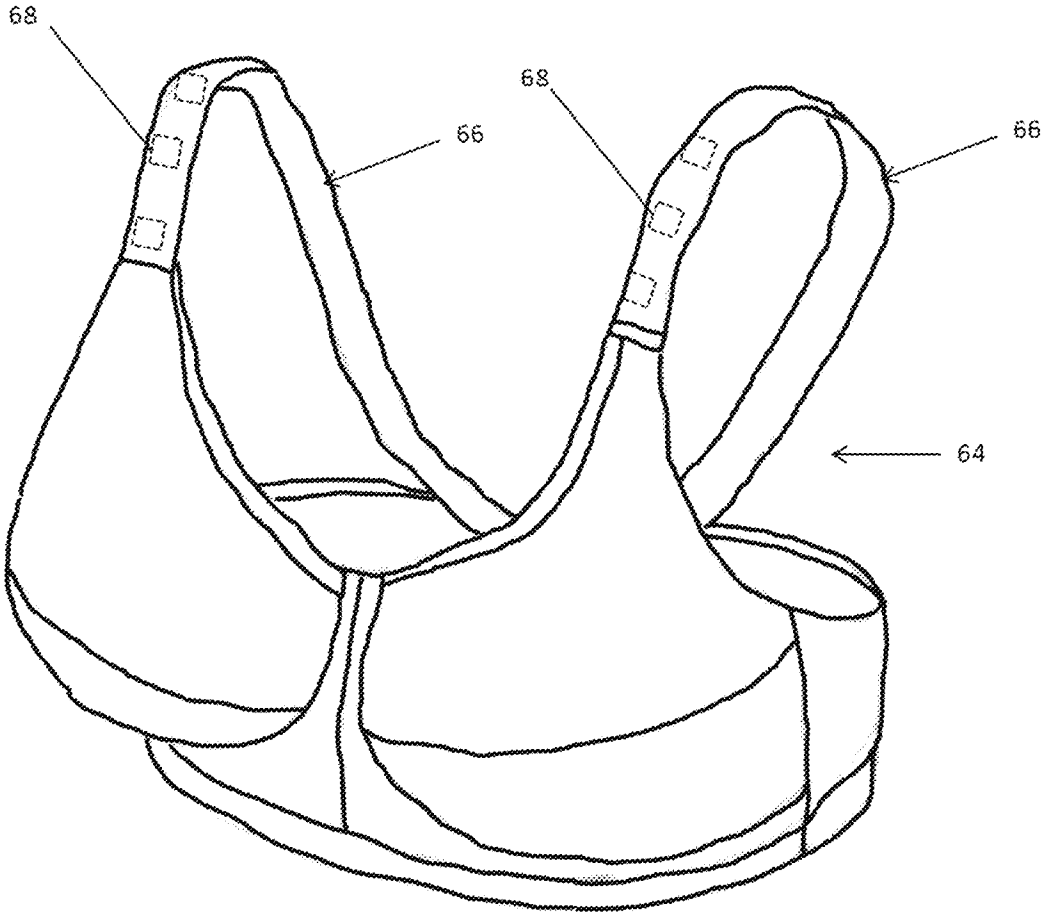
FIG. 11A is a front perspective view of an embodiment of a bra according to the present invention having magnets sewn into the interior of the shoulder straps along their length.
Figure 11B:
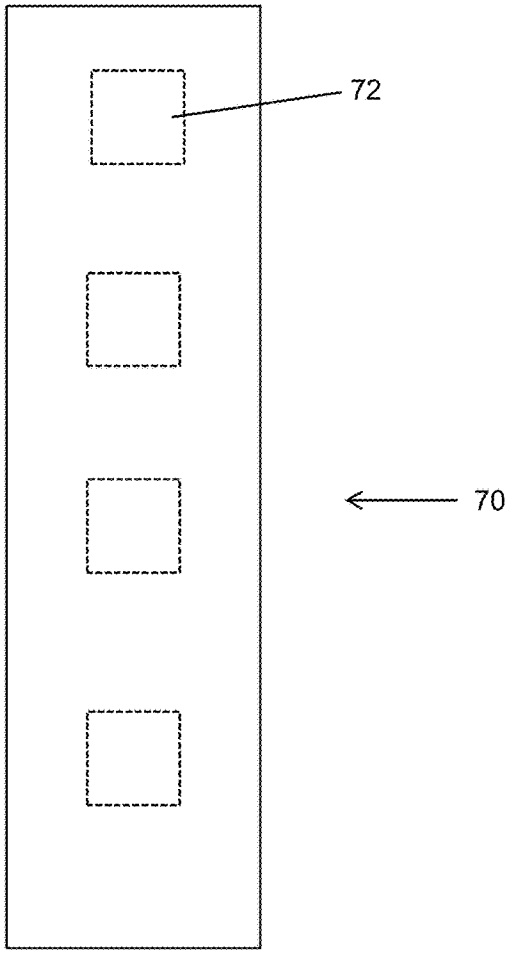
FIG. 11B is a bottom view of an interchangeable garment covering strap for use in connection with the bra of FIG. 11A, the strap having magnets sewn into the interior of the strap along its length.

FIG. 11A shows a bra 64 according to one embodiment of the present invention. Bra 64 may be similar in many or all respects to the bra embodiments previously described. Bra 64 includes adjustable shoulder straps 66. In this embodiment, a plurality of magnets (i.e., first fastener halves) 68 may be sewn into the interior of the shoulder straps 66 at intervals along their length. Magnets 68 may be positively or negatively charged. Bra 64 is configured for use in connection with the interchangeable cover 70 shown in FIG. 11B. Cover 70 may be similar in many or all respects to the cover embodiments previously described. Cover 70 has a plurality of magnets (i.e., second fastener halves) 72 sewn into its interior at intervals along the cover's length corresponding to the intervals of the magnets 68 sewn into the interior of the shoulder straps 66 of bra 64. Magnets 72 are configured so as to be complementary to and attached or mating to magnets 68. Of course, the selection of positive or negative polarity of magnets as first and second fastener halves may be reversed, so long as the fasteners may mate. As with the embodiments shown in and described in conjunction with FIGS. 10A and 10B, the use of magnets at intervals along the length of the shoulder straps and cover allows for the free movement and use of the elasticity of the shoulder straps and cover (i.e., the relative strain), such that comfort of the wearer is increased, the shoulder straps and cover are less likely to slip from the shoulder, and "bunching" of the cover is avoided.

Figure 12:
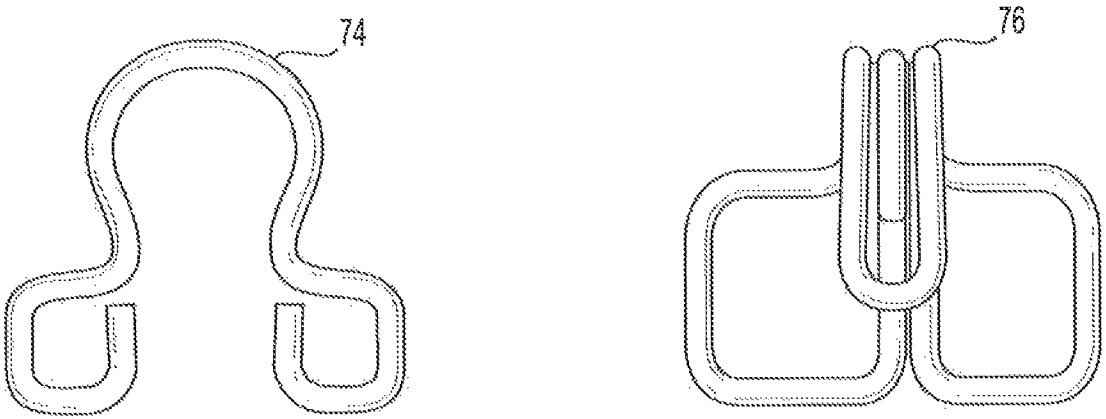
FIG. 12 is a front view of hook-and-eye style fasteners that can be used to secure the strap cover to the bra according to one embodiment of the present invention.

In one or more alternative embodiments, a bra strap cover can be secured to a bra strap via other attachment systems. For example, hook-and-eye style fasteners may be used. FIG. 12 shows one example of such a system comprising an eye 74 and a hook 76. In such embodiments, a plurality of such eyes 74 may be disposed along the length of a bra's shoulder strap. A plurality of hooks 76 as first and second fasteners may be disposed along the length of a bra strap cover so as to allow the bra strap cover to be removably attached to the bra strap. In the previously-described embodiments that use the variously-described alternative attachment systems for securing the strap cover to the bra strap, the top of each cup where a garment strap attaches to a cup portion of a bra can include one or more female-sided snap fasteners, one or more openings each of which is configured to receive a button and/or a magnet, and one or more magnets sewn into the fabric of the cup. In various embodiments, the plurality of first and second fastener halves mate to form fasteners selected from the group consisting of male and female snap fasteners, magnets, buttons and button holes, clasp halves, buttons and loops, hook and loop style fastener tape, hooks and eyes, and combinations thereof. In other embodiments, the plurality of first and second fastener halves are stretchy loop-style fastener tape.

Figure 13A:
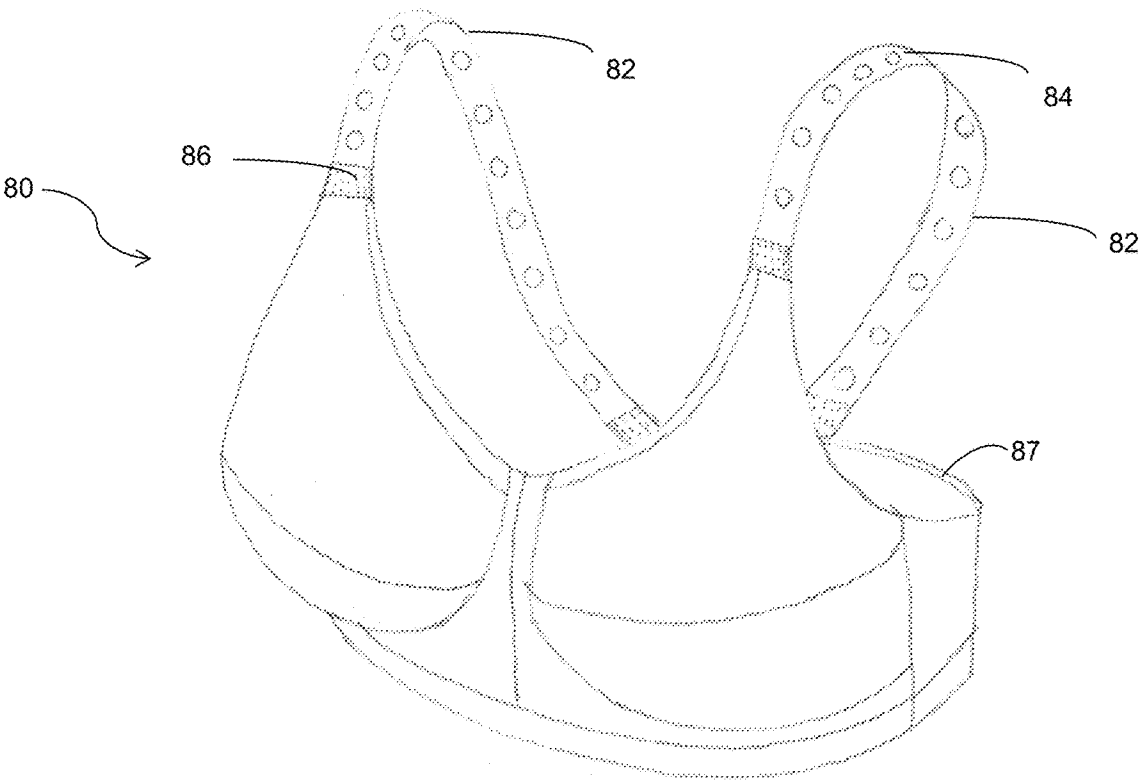
FIG. 13A is a front perspective view of a front side of a bra.
Figure 13B:
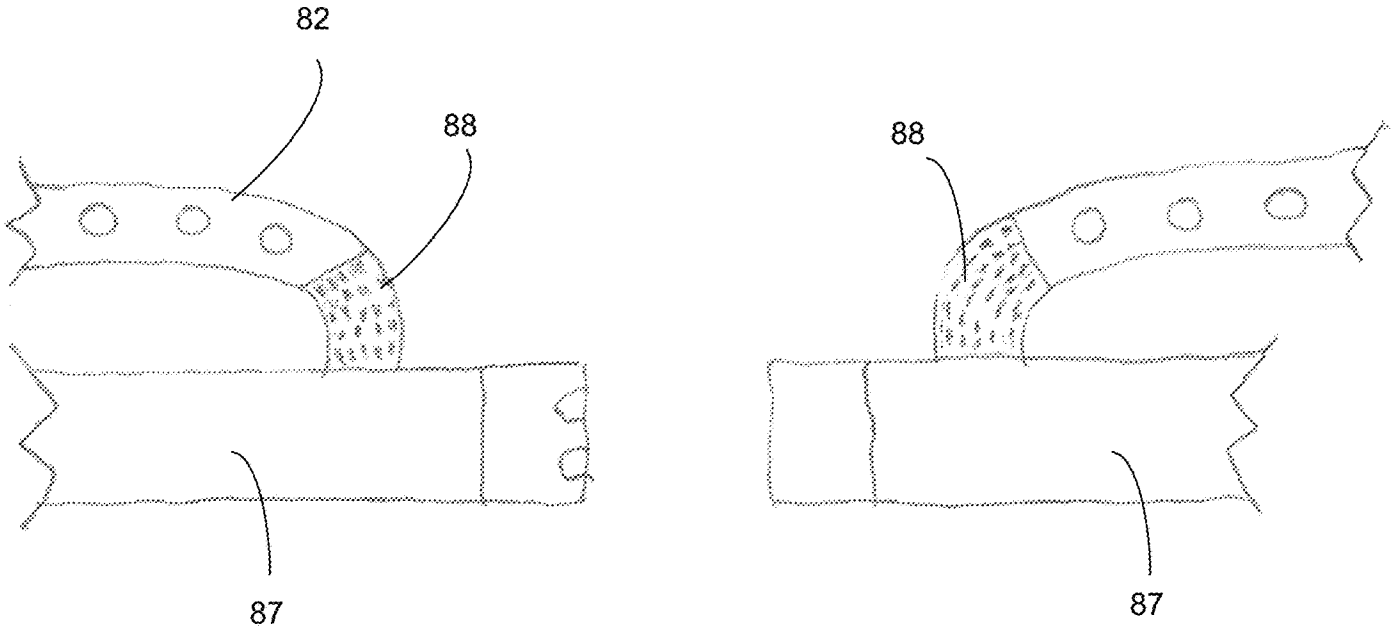
FIG. 13B is a view of a back side of the bra of FIG. 13A.

FIG. 13A is an alternative embodiment with bra 80, straps 82, similar to that of FIG. 10A with buttons (i.e., first fastener halves) 84, but with certain optional features. As shown as shown in FIG. 13A for example, optional hook-and-loop style fastener tape(s) (or other means for attachment) 86 may be included on the upper portion of a bra cup just below the place that a garment strap (not shown) may attach to the underlying garment 80. As shown, if the length of a designer strap cover is slightly longer than the length of a corresponding garment strap 82, then the extra length of the designer strap cover can attach to the optional hook-and-loop style fastener tape(s) 86 on the bra cup and provide additional security for the installed cover. As shown in FIG. 13B, for example, any additional length of designer strap cover may be attached to hook-and-loop style fastener tape(s) 88 on the back of the body straps 87 of the underlying bra.

Figure 14A:
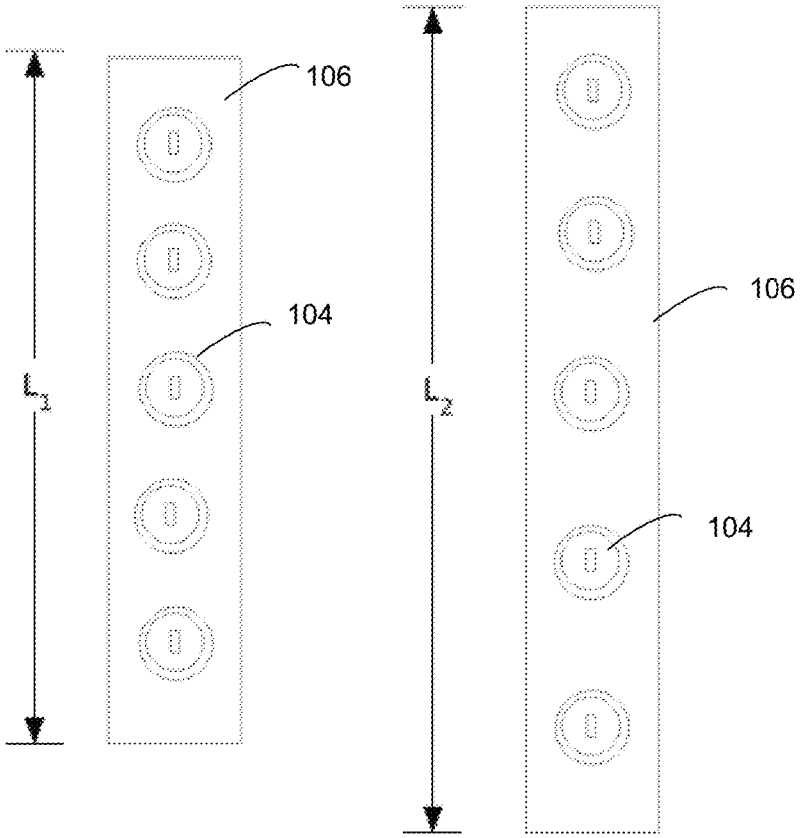
FIG. 14A is a bottom view of an embodiment of an elastic strap cover.
Figure 14B:
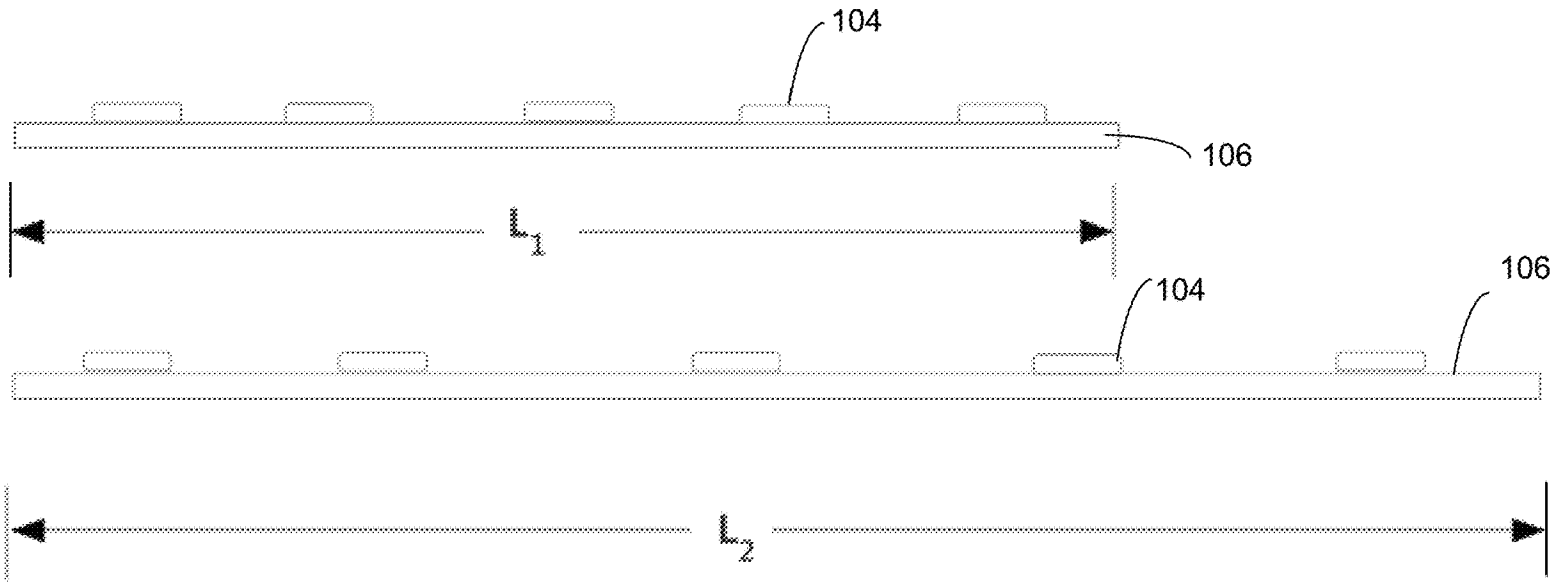
FIG. 14B is a side view of an embodiment of an elastic strap cover.
Figure 15:
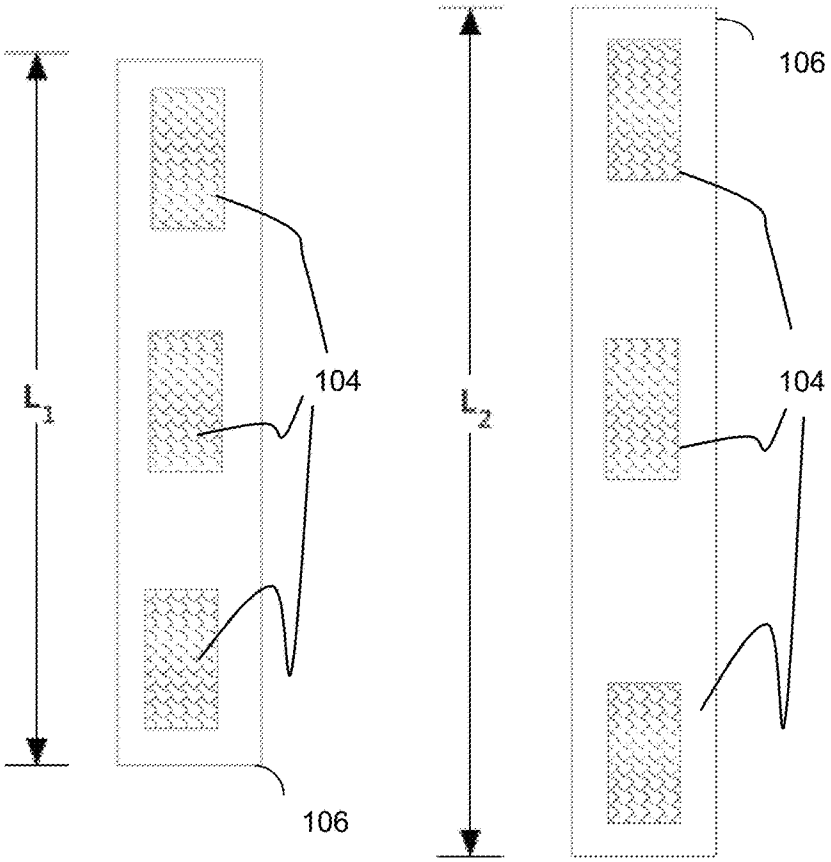
FIG. 15 is a bottom view of an embodiment of an elastic strap cover.
Figure 16A:
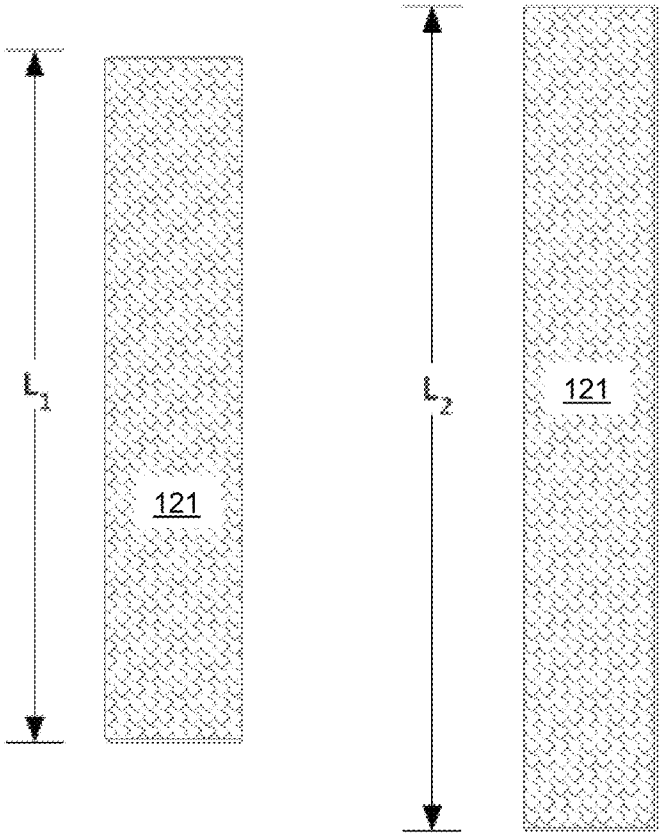
FIG. 16A is a bottom view of an embodiment of an elastic strap cover.
Figure 16B:
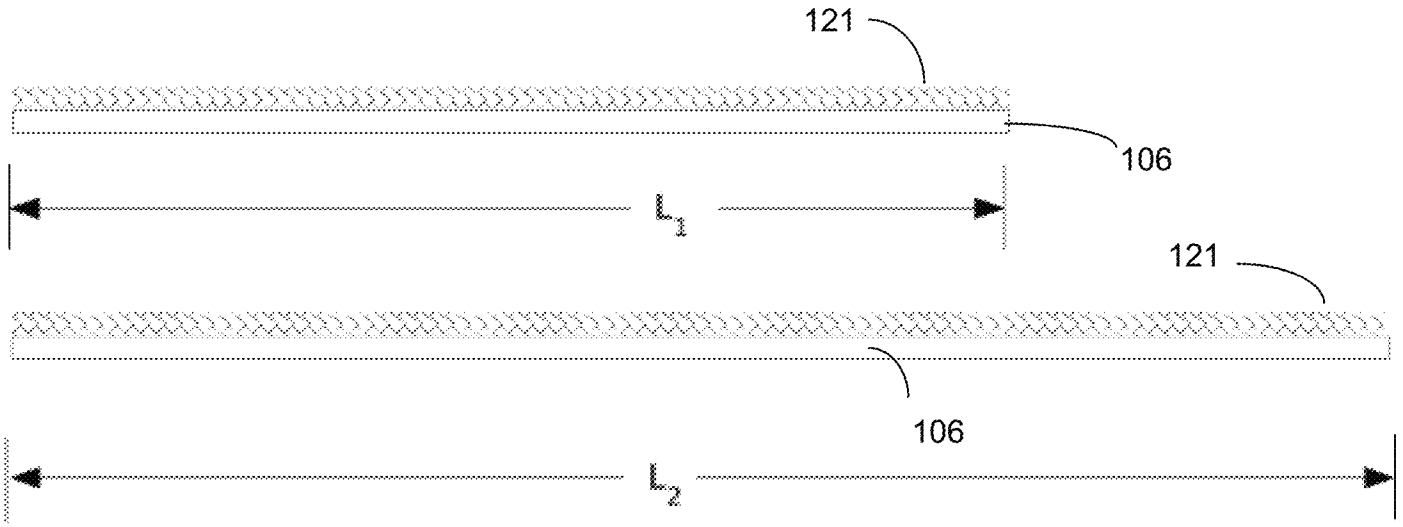
FIG. 16B is a side view of an embodiment of an elastic strap cover.

FIGS. 14A and 14B illustrate elasticity and strain characteristics of cover 106, which under a given stress or tension, shows cover 106 with buttons as second fastener halves 104 shown with application of a given stress, so as to produce a strain with length L2 being greater or longer than L1. FIG. 15 illustrates elasticity and strain characteristics of cover 106, which under a given stress or tension, shows cover 106 with hook-and-loop fasteners as second fastener halves 104 shown with application of a given stress, so as to produce a strain with length L2 being greater or longer than L1. FIGS. 16A and 16B illustrate elasticity and strain characteristics of cover 106, which under a given stress or tension, shows cover 106 with stretchy loop-style fastener tape 121 as second fastener halves 104 shown with application of a given stress, so as to produce a strain with length L2 being greater or longer than L1. Stretchy loop-style fastener tape 121 provides a convenient, but not exclusive, approach to achieving or enabling a desired elasticity and relative strain.

The dimensions described herein will be understood to be exemplary and provided as embodiments associated with proper working operation of the present invention. Furthermore, while the preferred embodiment disclosed herein is illustrated as applying to or incorporating a bra, alternative shapes and sizes of garments are to be considered. For example, a garment incorporating interchangeable designer straps as described herein could be a dress, a shirt, lingerie, tank tops, halter tops, or any other article of clothing.

The terminology used herein is for the purpose of describing particular embodiments only and is not intended to be limiting of the approach. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed is:

1. A bra strap cover system comprising:

a bra comprising at least one shoulder strap, at least one body strap, and at least one cup, said at least one shoulder strap having a top surface, a bottom surface, a strap length, and a strap width, wherein the top surface of said at least one shoulder strap, an upper portion of the at least one cup, and a back portion of the body strap include a plurality of first fastener halves, with the first fastener halves on the top surface of said at least one shoulder strap disposed along the strap length;

at least one bra strap cover having a decorative upper face, a lower face, a cover length, and a cover width, said lower face having a plurality of second fastener halves disposed along the cover length, said cover width being greater than said strap width and wherein for a given stress, the bra strap cover has a relative strain of 0.1 or greater, relative to the shoulder strap; and wherein the bra strap cover is configured to be removably attached to said shoulder strap by mating the plurality of first and second fastener halves together such that the bra strap cover substantially covers and overlies the top surface of said shoulder strap, and wherein the cover length when overlying the shoulder strap extends from the upper portion of the at least one cup to the back portion of the body strap so that the bra strap cover is further configured to be removably attached to the upper portion of the at least one cup to the back portion of the body strap by mating the plurality of first and second fastener halves together.

2. The bra strap system of claim 1, wherein the plurality of first and second fastener halves mate to form fasteners selected from the group consisting of male and female snap fasteners, magnets, buttons and button holes, clasp halves, buttons and loops, hook and loop style fastener tape, hooks and eyes, and combinations thereof.

3. The bra strap system of claim 1, wherein the plurality of first and second fastener halves are stretchy loop-style fastener tape.

4. A bra strap cover system comprising:

a bra comprising at least one shoulder strap, at least one body strap, and at least one cup, said at least one shoulder strap having a top surface, a bottom surface, a strap length, and a strap width, said at least one shoulder strap, an upper portion of the at least one cup, and a back portion of the body strap have a plurality of openings, with the openings on the top surface of said at least one shoulder strap disposed along said strap length;

at least one bra strap cover having a decorative upper face, a lower face, a cover length, and a cover width, said cover width being greater than said strap width, said lower face having a plurality of buttons attached thereto along said cover length; and wherein the bra strap is configured to be removably attached to said shoulder strap by mating the plurality of buttons with the plurality of openings such that the bra strap cover substantially covers and overlies the top surface of said shoulder strap, and wherein the cover length when overlying the shoulder strap extends from the upper portion of the at least one cup to the back portion of the body strap so that the bra strap cover is further configured to be removably attached to the upper portion of the at least one cup to the back portion of the body strap by mating the plurality of buttons with the plurality of openings.

5. The bra strap system of claim 4, wherein for a given stress, the at least one bra strap cover has a relative strain of 0.1, relative to the at least one shoulder strap.

6. A bra strap cover system comprising:

a first and a second snap fastener tape, the first and second snap fastener tape configured to attach to each other by a plurality of male and female snap fasteners disposed on the first and second snap fastener tape, with the first snap fastener tape having male snap fasteners and the second snap fastener tape having female snap fasteners, with the first and second snap fastener tape being elastic;

a bra comprising at least one shoulder strap, at least one body strap, and at least one cup, said at least one shoulder strap having a top surface, a bottom surface, a strap length, and a strap width, wherein the top surface of said at least one shoulder strap, a rear portion of the body strap, and a top portion of the at least one cup include portions of the first snap fastener tape attached thereto;

at least one bra strap cover having a decorative upper face, a lower face, a cover length, and a cover width, said lower face having the second snap fastener tape having female snap fasteners attached thereto and extending along said cover length, said cover width being greater than said strap width;

wherein the female snap fastener of the second snap fastener tape are configured to be removably attached to the male snap fasteners of the first snap fastener tape, so that a first end of said bra strap cover is configured to be removably attached to said top portion of said cup, a second end of said bra strap cover is configured to be removably attached to said rear portion of said body strap, and an intermediate portion of said bra strap cover is configured to be removably attached to said shoulder strap such that the bra strap cover substantially covers and overlies the top surface of said shoulder strap.

7. The bra strap system of claim 6, wherein for a given stress, the at least one bra strap cover has a relative strain of 0.1 or greater, relative to the at least one shoulder strap.

8. A bra strap cover system comprising:

a hook-and-loop fastener tape connector including a first fastener hook component and a second fastener loop component configured to attach to each other by a plurality of hooks disposed on the first component and a plurality of loops disposed on the second loop component of the connector;

a bra comprising at least one shoulder strap, at least one body strap, and at least one cup, said at least one shoulder strap having a top surface, a bottom surface, a strap length, and a strap width, wherein the top surface of said at least one shoulder strap, a rear portion of the body strap, and a top portion of the at least one cup include portions of the first fastener hook component of the fastener tape connector attached thereto;

at least one bra strap cover having a decorative upper face, a lower face, a cover length, and a cover width, said lower face having the second fastener loop component of the fastener tape connector attached thereto and extending along said cover length, said cover width being greater than said strap width;

wherein the second loop component of the fastener tape connector is configured to be removably attached to the first hook component of the tape connector so that a first end of said bra strap cover is configured to be removably attached to said top portion of said cup, a second end of said bra strap cover is configured to be removably attached to said rear portion of said body strap, and an intermediate portion of said bra strap cover is configured to be removably attached to said shoulder strap such that the bra strap cover substantially covers and overlies the top surface of said shoulder strap.

9. The bra strap system of claim 8, wherein the hook-and-loop fastener tape is elastic and for a given stress, the at least one bra strap cover has a relative strain of 0.1 or greater, relative to the at least one shoulder strap.

10. A bra strap cover system comprising:

a hook-and-loop fastener tape connector including a first fastener loop component and a second fastener hook component configured to attach to each other by a plurality of loops disposed on the first component and a plurality of hooks disposed on the second hook component of the connector;

a bra comprising at least one shoulder strap, at least one body strap, and at least one cup, said at least one shoulder strap having a top surface, a bottom surface, a strap length, and a strap width, wherein the top surface of said at least one shoulder strap, a rear portion of the body strap, and a top portion of the at least one cup include portions of the first fastener loop component of the fastener tape connector attached thereto;

at least one bra strap cover having a decorative upper face, a lower face, a cover length, and a cover width, said lower face having the second fastener hook component of the fastener tape connector attached thereto and extending along said cover length, said cover width being greater than said strap width;

wherein the second hook component of the fastener tape connector is configured to be removably attached to the first loop component of the tape connector so that a first end of said bra strap cover is configured to be removably attached to said top portion of said cup, a second end of said bra strap cover is configured to be removably attached to said rear portion of said body strap, and an intermediate portion of said bra strap cover is configured to be removably attached to said shoulder strap such that the bra strap cover substantially covers and overlies the top surface of said shoulder strap.

11. The bra strap system of claim 10, wherein the hook-and-loop fastener tape connector is elastic and for a given stress, the at least one bra strap cover has a relative strain of 0.1 or greater, relative to the at least one shoulder strap.

12. A bra strap cover system comprising:

a first and a second snap fastener tape, the first and second snap fastener tape configured to attach to each other by a plurality of male and female snap fasteners disposed on the first and second snap fastener tape, with the first snap fastener tape having female snap fasteners and the second snap fastener tape having male snap fasteners, with the first and second snap fastener tape being elastic;

a bra comprising at least one shoulder strap, at least one body strap, and at least one cup, said at least one shoulder strap having a top surface, a bottom surface, a strap length, and a strap width, wherein the top surface of said at least one shoulder strap, a rear portion of the body strap, and a top portion of the at least one cup include portions of the first snap fastener tape attached thereto;

at least one bra strap cover having a decorative upper face, a lower face, a cover length, and a cover width, said lower face having the second snap fastener tape having male snap fasteners attached thereto and extending along said cover length, said cover width being greater than said strap width;

wherein the male snap fastener of the second snap fastener tape are configured to be removably attached to the female snap fasteners of the first snap fastener tape, so that a first end of said bra strap cover is configured to be removably attached to said top portion of said cup, a second end of said bra strap cover is configured to be removably attached to said rear portion of said body strap, and an intermediate portion of said bra strap cover is configured to be removably attached to said shoulder strap such that the bra strap cover substantially covers and overlies the top surface of said shoulder strap.

13. The bra strap system of claim 12, wherein for a given stress, the at least one bra strap cover has a relative strain of 0.1 or greater, relative to the at least one shoulder strap.

* * * * *